US007589751B2

(12) United States Patent
Fukutome et al.

(10) Patent No.: US 7,589,751 B2
(45) Date of Patent: Sep. 15, 2009

(54) IMAGE FORMING APPARATUS AND METHOD FOR ADJUSTING THE INTERVAL BETWEEN A WRITE HEAD AND A PHOTORECEPTOR

(75) Inventors: Shohichi Fukutome, Nara (JP); Ayumu Oda, Nara (JP); Takaharu Motoyama, Kashihara (JP); Tomohiko Okada, Kyoto (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 285 days.

(21) Appl. No.: 11/601,767

(22) Filed: Nov. 20, 2006

(65) Prior Publication Data

US 2007/0126852 A1 Jun. 7, 2007

(30) Foreign Application Priority Data

Dec. 5, 2005 (JP) ..... 2005-350852

(51) Int. Cl.
*G03G 13/04* (2006.01)
*B41J 2/435* (2006.01)
*B41J 25/308* (2006.01)

(52) U.S. Cl. ..... 347/138; 347/8; 347/263; 399/126

(58) Field of Classification Search ..... 347/242, 347/245, 138; 399/126, 138, 193, 205, 347, 399/354

See application file for complete search history.

(56) References Cited

U.S. PATENT DOCUMENTS 4,703,334 A * 10/1987 Mochimaru et al. ..... 347/138
5,612,767 A * 3/1997 Iwama ..... 347/242
6,315,469 B1 * 11/2001 Alvarez et al. ..... 347/8
6,523,921 B2 * 2/2003 Codos ..... 347/8
6,801,232 B2 * 10/2004 Nagamine et al. ..... 347/149
6,809,752 B2 * 10/2004 Nagamine ..... 347/242
2004/0008333 A1 * 1/2004 Oda et al. ..... 355/55
2004/0051923 A1 * 3/2004 Park ..... 359/200

FOREIGN PATENT DOCUMENTS

JP 62166372 A * 7/1987
JP 62239175 A * 10/1987
JP 2001-130047 A 5/2001
JP 2003-173073 A 6/2003

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

An image forming apparatus comprises an adjusting mechanism that adjusts an interval between an LED head writing an optical image on a photoreceptor and a photoreceptor drum to a reference interval (A), and the adjusting mechanism includes a regulating member attached to the LED head. In the adjustment of the interval between the LED head and the photoreceptor drum, the LED head and the regulating member are integrally moved until the regulating member comes into contact with the photoreceptor drum. The interval between the LED head and the photoreceptor drum is (A-B) at this point. The LED head and the regulating member are moved in the direction opposite to the photoreceptor drum by a distance (B). As a result, the interval between the LED head and the photoreceptor drum is set to the reference interval (A).

9 Claims, 21 Drawing Sheets

STEP1

STEP2

STEP3

STEP4

FIG.8A

STEP1

| ADJUSTMENT SCREEN | CONTACT |
|---|---|
| PIN F : | × |
| PIN R : | × |

FIG.8B

STEP2

| ADJUSTMENT SCREEN | CONTACT |
|---|---|
| PIN F : | ○ |
| PIN R : | × |

FIG.8C

STEP3

| ADJUSTMENT SCREEN | CONTACT |
|---|---|
| PIN F : | ○ |
| PIN R : | ○ |

FIG.8D

STEP4

| ADJUSTMENT SCREEN | CONTACT |
|---|---|
| PIN F : | × |
| PIN R : | × |

STEP1

STEP2

STEP3

STEP4

FIG.14A

STEP1

| ADJUSTMENT SCREEN | CONTACT |
|---|---|
| PIN F : | × |
| PIN R : | × |

FIG.14B

STEP2

| ADJUSTMENT SCREEN | CONTACT |
|---|---|
| PIN F : | ○ |
| PIN R : | × |

FIG.14C

STEP3

| ADJUSTMENT SCREEN | CONTACT |
|---|---|
| PIN F : | × |
| PIN R : | ○ |

FIG.14D

STEP4

| ADJUSTMENT SCREEN | CONTACT |
|---|---|
| PIN F : | × |
| PIN R : | × |

DIAMETER IS DIFFERENT

ECCENTRICITY OF ROTATION SHAFT

ELLIPSE SHAPE

LED-TO-PHOTORECEPTOR DISTANCE=A−B

LED-TO-PHOTORECEPTOR DISTANCE<A−B

IMAGE FORMING APPARATUS AND METHOD FOR ADJUSTING THE INTERVAL BETWEEN A WRITE HEAD AND A PHOTORECEPTOR

CROSS-NOTING PARAGRAPH

This Nonprovisional application claims priority under 35 U.S.C. §119 (a) on Patent Application No. 2005-350852 filed in JAPAN on Dec. 5, 2005, the entire contents of which are hereby incorporated herein by references.

FIELD OF THE INVENTION

The present invention relates generally to an image forming apparatus and an adjusting method of an image forming apparatus, and, more particularly, to an image forming apparatus with an adjusting mechanism that adjusts an interval between a write head writing an optical image on a photoreceptor and the photoreceptor to a reference interval, and an adjusting method of the image forming apparatus.

BACKGROUND OF THE INVENTION

A write head such as an LED (Light Emitting Diode) head is used in an electrophotographic image forming apparatus such as a digital multi-function peripheral (MFP), printer, and facsimile machine and is positioned and attached with a predetermined interval from a photoreceptor drum to achieve high-quality images.

However, it is difficult to assemble mass-produced image forming apparatuses such that intervals between the write heads and the photoreceptors become completely the same, and some variance is generated at the time of assembly. Therefore, the position of the write head must be adjusted in each apparatus after the assembly such that the interval between the write head and the photoreceptor falls within a certain tolerance to achieve images with a predetermined quality.

Therefore, in a conventional electrophotographic image forming apparatus such as an MPF, a mechanism adjusting the position of the LED head is disposed in a main body of the image forming apparatus. In a manufacturing line of the image forming apparatus, a photoelectric transducer such as a CCD is mounted on the photoreceptor mounting position and an adjustment work is performed by detecting an LED exposure spot shape from the CCD output and using a dedicated jig for adjusting the LED head position.

On the other hand, in electrophotographic image forming apparatuses, photoreceptors are consumables, and a variance is generated in a distance between the photoreceptor surface and the LED head due to an individual difference of the photoreceptor mounting position. A lens built into the LED head has a focal depth of only ±0.1 mm, and if the variance exceeds the focal depth, a desired image quality cannot be acquired unless focus adjustment is performed such that the focal point of the light emitted from the LED head conforms to the photoreceptor surface after replacing the photoreceptor.

Since the apparatus of the above dedicated jig is large and expensive, the dedicated jig cannot be used when a service person visits a customer's site to adjust the LED head position, and since the position is adjusted by performing test print and visually checking printed line widths, this operation takes a long time and adjustment accuracy is low in reality.

In view of the above situations, a clamshell image forming apparatus is known which can be opened at a lower portion of the LED head. Since the clamshell image forming apparatus can be opened at the lower portion of the LED head, when positioning the write head and the photoreceptor drum with a predetermined distance, the mounting position of the write head can easily be adjusted.

Japanese Laid-Open Patent Publication No. 2001-130047 discloses a technology of reducing a focal shift generated when correcting a position shift of a scanning line in an electrophotographic recording apparatus using an LED head by bring a contact rod into contact with a photoreceptor surface to maintain a constant distance between the LED head and the photoreceptor surface. Japanese Laid-Open Patent Publication No. 2003-173073 discloses a technology capable of adjusting a distance between a writing head and a photoreceptor drum, and the scanning inclination of the writing head relative to the photoreceptor drum from the side portion of a main body apparatus.

If a user must replace consumables or adjust parts in the electrophotographic image forming apparatuses during use, a skilled "service man" performs the operation. Conventionally, it has been insisted that the maintenance by a service man must be shifted to "user maintenance", and the "user maintenance" is introduced in the case of a portion of parts, for example, a process kit, since the printing quality is not deteriorated and the apparatus is not damaged even when a user replaces the parts. However, in the case of parts that are a core of the electrophotographic mode, the operation is dependent on the "service man maintenance".

Especially, with regard to the mounting adjustment of image writing members such as an optical unit and LED head using laser light which has an influence on the print quality, the operation is regarded as an essential item of the "service man maintenance", not only since a lot of skill is required to perform dot diameter adjustment using a print image at a mounting site after the adjustment of the image forming apparatus at the time of factory shipment but also from a standpoint of having an influence on the print quality. The mounting adjustment of image writing members such as an optical unit and LED head must be performed every time an electrostatic latent image support (photoreceptor) is replaced in addition to the above maintenance and, since the adjustment operation is difficult, the adjustment has been omitted at the time of the replacement of the photoreceptor in a normal process.

In recent years, print resolution is increased from conventional 300 dpi to 600 and 1200 dpi as higher quality images are formed by image forming apparatuses, and it is difficult even for a skilled service man to respond such increment with the conventional adjustment technique. For reference, in the case of 1200 dpi, a dot diameter of one dot is generally 12 to 13 μm, which cannot be recognized.

Due to eccentricity, deformation, diameter variance, etc., of the photoreceptor drum including the photoreceptor, a distance between the write head and the photoreceptor is changed depending on a rotation angle. Therefore, if the interval adjustment is performed at a position where the distance is maximized between the write head and the photoreceptor, the distance between the write head and the photoreceptor drum becomes too small at other positions; contrary, if the interval adjustment is performed at a position where the distance is minimized between the write head and the photoreceptor, the distance between the write head and the photoreceptor drum becomes too large at other positions; and in either case, the optimum interval adjustment cannot be performed.

When adjusting the interval between the write head and the photoreceptor, if a line extended from a regulating member is shifted such that the line does not intersect with a center line of the drum rotation axis, i.e., if the position of the regulating member is shifted from the photoreceptor drum in the sub-scanning direction, the shape of the exposure spot applied to the photoreceptor does not become a perfect circle and a sharp latent image cannot be formed on the photoreceptor.

SUMMARY OF THE INVENTION

An object of the present invention is to provide an image forming apparatus that includes an adjusting mechanism enabling an unskilled user to easily and certainly check an interval between a write head and a photoreceptor to adjust the interval highly accurately, and a method of adjusting the interval between the write head and the photoreceptor.

Another object of the present invention is to provide an image forming apparatus that adjusts an interval between a write head and a photoreceptor when a photoreceptor drum is located at a predetermined rotation position to prevent the interval between the write head and the photoreceptor from becoming too small or too large in one rotation of the photoreceptor drum and making a photoreceptor surface out of a range of focal depth of the write head even if acceptable eccentricity, deformation, diameter variance, etc., are generated in the photoreceptor drum, and a method of adjusting the interval between the write head and the photoreceptor.

Another object of the present invention is to provide an image forming apparatus that corrects a shift between a regulating member and a photoreceptor drum in a sub-scanning direction when adjusting an interval between a write head and a photoreceptor and that subsequently adjusts the interval between the write head and the photoreceptor to accurately adjust the interval between the write head and the photoreceptor, and a method of adjusting the interval between the write head and the photoreceptor.

More specifically, an object of the present invention is to provide an image forming apparatus comprising an adjusting mechanism that adjusts an interval between a write head writing an optical image on a photoreceptor and the photoreceptor to a reference interval, the adjusting mechanism including a regulating member that integrally moves along with the write head in the direction of the photoreceptor to regulate the interval between the write head and the photoreceptor; a moving mechanism that integrally moves the regulating member along with the write head to bring the regulating member into contact with the photoreceptor; and a reverse-moving mechanism that integrally moves the regulating member along with the write head in the direction opposite to the photoreceptor by a predetermined distance after the regulating member comes into contact with the photoreceptor to set the interval between the write head and the photoreceptor to the reference interval.

Another object of the present invention is to provide the image forming apparatus, comprising: a contact detection mechanism that detects the contact between the regulating member and the photoreceptor from presence of electric conductivity; and a mechanism that performs notification of the detection result of the contact detection mechanism.

Another object of the present invention is to provide the image forming apparatus, wherein the regulating member contacts with a conductive non-image area disposed at both ends of the photoreceptor and the moving mechanism and the reverse-moving mechanism can independently move both ends of the write head.

Another object of the present invention is to provide the image forming apparatus, wherein when adjusting the interval between the write head and the photoreceptor, the regulating member is brought into contact with the photoreceptor while the photoreceptor is rotated.

Another object of the present invention is to provide an image forming apparatus comprising an adjusting mechanism that adjusts an interval between a write head writing an optical image on a photoreceptor and the photoreceptor to a reference interval, the adjusting mechanism including a regulating member that integrally moves along with the write head in the direction of the photoreceptor to regulate the interval between the write head and the photoreceptor; a mechanism that mounts a spacer with a predetermined thickness to the photoreceptor; a moving mechanism that integrally moves the regulating member along with the write head to bring the regulating member into contact with the spacer; and a mechanism that removes the spacer after the regulating member comes into contact with the spacer.

Another object of the present invention is to provide the image forming apparatus comprising: a contact detection mechanism that detects the contact between the regulating member and the spacer from presence of electric conductivity; and a mechanism that performs notification of the detection result of the contact detection mechanism.

Another object of the present invention is to provide the image forming apparatus, wherein the regulating member contacts with the spacer mounted to both ends of the photoreceptor and the moving mechanism can independently move both ends of the write head.

Another object of the present invention is to provide an image forming apparatus comprising an adjusting mechanism that adjusts an interval between a write head writing an optical image on a photoreceptor on a drum and the photoreceptor to a reference interval, the adjusting mechanism including an adjusting member that integrally moves along with the write head to adjust the interval between the write head and the photoreceptor and a detecting member that comes into contact with the photoreceptor drum to detect the interval between the write head and the photoreceptor, the detecting member obtaining a place on the photoreceptor where the photoreceptor becomes closest to the write head and a place on the photoreceptor where the photoreceptor becomes farthest from the write head to adjust the interval between the write head and the photoreceptor to an intermediate position between the obtained places.

Another object of the present invention is to provide the image forming apparatus, comprising: a contact detection mechanism that detects the contact between the detecting member and the photoreceptor drum from presence of electric conductivity; and a mechanism that performs notification of the detection result of the contact detection mechanism.

Another object of the present invention is to provide an image forming apparatus comprising an adjusting mechanism that adjusts an interval between a write head writing an optical image on a photoreceptor on a drum and the photoreceptor to a reference interval, the adjusting mechanism including a regulating member that integrally moves along with the write head in the direction of the photoreceptor to regulate the interval between the write head and the photoreceptor; a sub-scanning direction position detecting member that detects a position of the regulating member in the sub-scanning direction relative to the photoreceptor drum; and a sub-scanning direction moving mechanism that moves the write head in the sub-scanning direction, after the sub-scanning direction position detecting member and the sub-scanning direction moving mechanism adjust a sub-scanning direction position of the write head, the apparatus using the regulating member to adjust the interval between the write head and the photoreceptor.

Another object of the present invention is to provide the image forming apparatus, wherein the sub-scanning direction position detecting member comes into contact with a rotation shaft of the photoreceptor drum when the write head reaches right above the photoreceptor.

Another object of the present invention is to provide the image forming apparatus, wherein the regulating member and the sub-scanning direction position detecting member are integrally formed and move closer or away in the direction of the photoreceptor along with the write head.

Another object of the present invention is to provide the image forming apparatus, wherein a distance between the center axis of the regulating member and a contact position bringing the sub-scanning direction position detecting member into contact with the rotation shaft of the photoreceptor drum is set larger than a radius of the rotation shaft of the photoreceptor drum by a predetermined distance and when detecting contact with the rotation shaft, the sub-scanning direction position detecting member is moved away from the contact position by the predetermined distance.

Another object of the present invention is to provide the image forming apparatus, comprising: an evacuation mechanism that evacuates the regulating member.

Another object of the present invention is to provide the image forming apparatus, wherein the photoreceptor is drum-shaped.

Another object of the present invention is to provide the image forming apparatus, wherein the write head is an LED head.

Another object of the present invention is to provide the image forming apparatus, wherein the photoreceptor is belt-shaped.

Another object of the present invention is to provide an adjusting method of an image forming apparatus, the apparatus comprising an adjusting mechanism that adjusts an interval between a write head writing an optical image on a photoreceptor and the photoreceptor to a reference interval, the adjusting mechanism including a regulating member that integrally moves along with the write head in the direction of the photoreceptor to regulate the interval between the write head and the photoreceptor, wherein after the regulating member is moved in the direction of the photoreceptor and brought into contact with the photoreceptor, the regulating member is integrally moved along with the write head in the direction opposite to the photoreceptor by a predetermined dimension to set the interval between the write head and the photoreceptor to the reference interval.

Another object of the present invention is to provide an adjusting method of an image forming apparatus, the apparatus comprising an adjusting mechanism that adjusts an interval between a write head writing an optical image on a photoreceptor and the photoreceptor to a reference interval, the adjusting mechanism including a mechanism that mounts a spacer with a predetermined thickness to the photoreceptor and a regulating member that integrally moves along with the write head in the direction of the photoreceptor to regulate the interval between the write head and the photoreceptor, wherein after the spacer is mounted to the photoreceptor and the regulating member is moved along with the write head in the direction of the photoreceptor and brought into contact with the spacer, the spacer is removed.

Another object of the present invention is to provide an adjusting method of an image forming apparatus, the apparatus comprising an adjusting mechanism that adjusts an interval between a write head writing an optical image on a photoreceptor on a drum and the photoreceptor to a reference interval, the adjusting mechanism including an adjusting member that integrally moves along with the write head to adjust the interval between the write head and the photoreceptor and a detecting member that comes into contact with the photoreceptor to detect the interval between the write head and the photoreceptor, wherein the detecting member obtains a place on the photoreceptor where the photoreceptor becomes closest to the write head and a place on the photoreceptor where the photoreceptor becomes farthest from the write head to adjust the interval between the write head and the photoreceptor to an intermediate position between the obtained places.

Another object of the present invention is to provide an adjusting method of an image forming apparatus, the apparatus comprising an adjusting mechanism that adjusts an interval between a write head writing an optical image on a photoreceptor on a drum and the photoreceptor to a reference interval, the adjusting mechanism including a regulating member that integrally moves along with the write head in the direction of the photoreceptor to regulate the interval between the write head and the photoreceptor, a sub-scanning direction position detecting member that detects a position of the regulating member in the sub-scanning direction relative to the photoreceptor drum, and a sub-scanning direction moving mechanism that moves the write head in the sub-scanning direction, wherein after the sub-scanning direction position detecting member and the sub-scanning direction moving mechanism adjust a sub-scanning direction position of the write head, the regulating member is used to adjust the interval between the write head and the photoreceptor.

BRIEF DESCRIPTION OF THE DRAWINGS

FIGS. 8A to 8D depict screens displayed on a display apparatus in the process of the interval adjustment shown in FIGS. 7A to 7D;

FIGS. 14A to 14D depict screens displayed on a display apparatus in the process of adjusting the interval between the write head and the photoreceptor;

PREFERRED EMBODIMENTS OF THE INVENTION

Embodiments of the present invention will now be described.

First Embodiment

Figure 1:
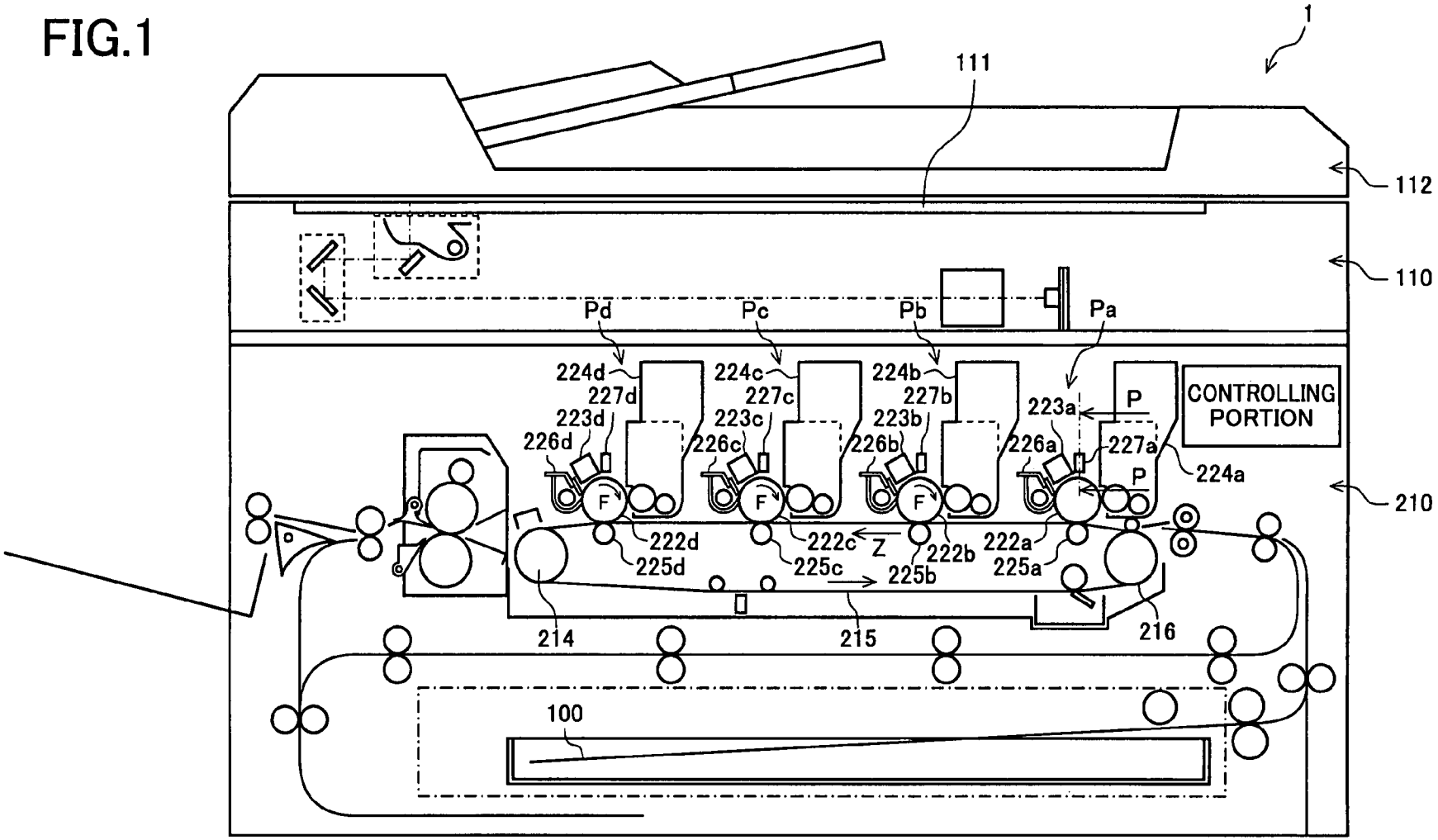
FIG. 1 is a sectional view of an overall configuration of a digital color copier that is an image forming apparatus of an embodiment of the present invention.

FIG. 1 is a sectional view of an overall configuration of a digital color copier that is an image forming apparatus of an embodiment of the present invention. An image forming apparatus 1 of the embodiment includes a document table 111 and an operation panel in the upper portion of the main body and includes an image reading portion 110 and an image forming portion 210 within the main body. On the upper surface of the document table 111, a reversing automatic document feeder (RADF) 112 is disposed and supported openable/closable to the document table 111 with a predetermined positional relationship with the document table 111.

The image forming apparatus 1 is an electrophotographic digital color copier that can copy a color image, reads an image of a document placed on the document table 111 or an image of a document fed by the reversing automatic document feeder 112 with the image reading portion 110, and reproduce the image of the read document on recording paper 100 with first to fourth image forming stations Pa, Pb, Pc, Pd of the image forming portion 210. The first image forming station Pa reproduces an image of a black component of the document image on the recording paper 100; the second image forming station Pb reproduces an image of a cyan component of the document image on the recording paper 100; the third image forming station Pc reproduces an image of a magenta component of the document image on the recording paper 100; and the fourth image forming station Pd reproduces an image of a yellow component of the document image on the recording paper 100. The first to fourth image forming stations Pa, Pb, Pc, Pd have the same configuration and are collectively described as an image forming station P.

The image forming station P is an unit that forms a toner image on the recording paper 100 and includes a cylindrical photoreceptor drum 222 supported rotatably and horizontally within a frame of the image forming apparatus 1, a charging device 223 that uniformly charges the photoreceptor, a developing device 224 that attaches toner to an electrostatic latent image formed on the surface of the photoreceptor for development, a transfer discharging device 225 that transfers the developed toner image on the photoreceptor surface to the recording paper 100, and a cleaning device 226 that removes toner remaining on the surface of the photoreceptor drum 222. The charging device 223, the developing device 224, the transfer discharging device 225, and the cleaning device 226 are sequentially arranged along the rotation direction of the photoreceptor drum 222. A transfer feed belt 215 feeding the recording paper 100 is disposed between the photoreceptor drum 222 and the transfer discharging device 225 and is driven by feed rollers 214, 216 to feed the recording paper 100 in a direction of an arrow Z. The photoreceptor drum 222 rotates in a direction of an arrow F around a rotation shaft extending in a direction perpendicular to the paper surface.

The image forming station P includes an LED head 227 that is a write head. The LED head 227 is disposed above the photoreceptor drum 222 such that the longitudinal direction thereof is substantially parallel to the axis direction of the photoreceptor drum 222, is located between the charging device 223 and the developing device 224 that are disposed along the rotation direction of the photoreceptor drum 222, and applies light to the photoreceptor surface charged by the charging device 223 to form the electrostatic latent image.

Figure 5:
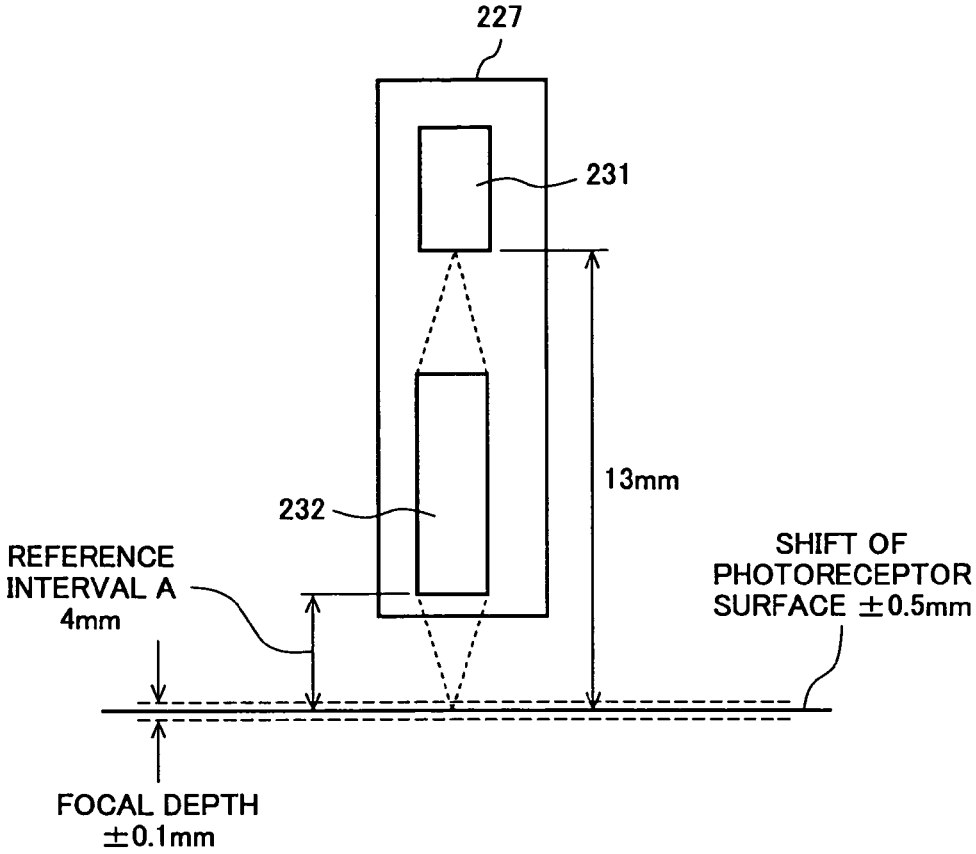
FIG. 5 is a partial sectional view enlarging a positional relationship between a write head and a photoreceptor surface.

FIG. 5 is a partial sectional view enlarging a positional relationship between the write head and the photoreceptor surface. The LED head 227 includes an LED substrate unit 231 including light emitting diodes (LED) that emit dot light modulated in accordance with image data and that are formed into a line shape on a substrate, a Selfoc lens array 232 that makes the light from the light emitting diodes focus on the surface of the photoreceptor drum 222, and a base member that is a framework of the LED head 227. The base member extends in the longitudinal direction of the LED head 227 and is made of a metal block with high rigidity. Since the LED head 227 generates heat, the base member is made of aluminum, which has a good thermal conductivity. Therefore, the heat generation of the LED head 227 can be suppressed. Since aluminum is used for the base member, the LED head 227 can have sufficient rigidity and the LED head can be configured with a lighter weight. The both ends of the base member project from the both ends of the LED head 227 to configure head supporting portions 2.

In an example of the Selfoc lens array 232 built into the LED head 227, if the Selfoc lens has a focal length of 4 mm, an interval between each Selfoc lens and the photoreceptor surface of the photoreceptor drum 222 is set to 4 mm, and an error of ±0.5 mm must be anticipated at the position of the photoreceptor surface due to dimensional accuracy of the photoreceptor drum 222. However, to keep a certain print quality, the focal depth of ±0.1 mm must be maintained for the Selfoc lens to the photoreceptor surface regardless of the position of the photoreceptor surface. Therefore, when replacing the photoreceptor drum 222, the position of the LED head 227 must be set such that the interval between the LED head 227 and the photoreceptor surface is, for example, 4±0.1 mm for each photoreceptor drum 222.

Figure 2:
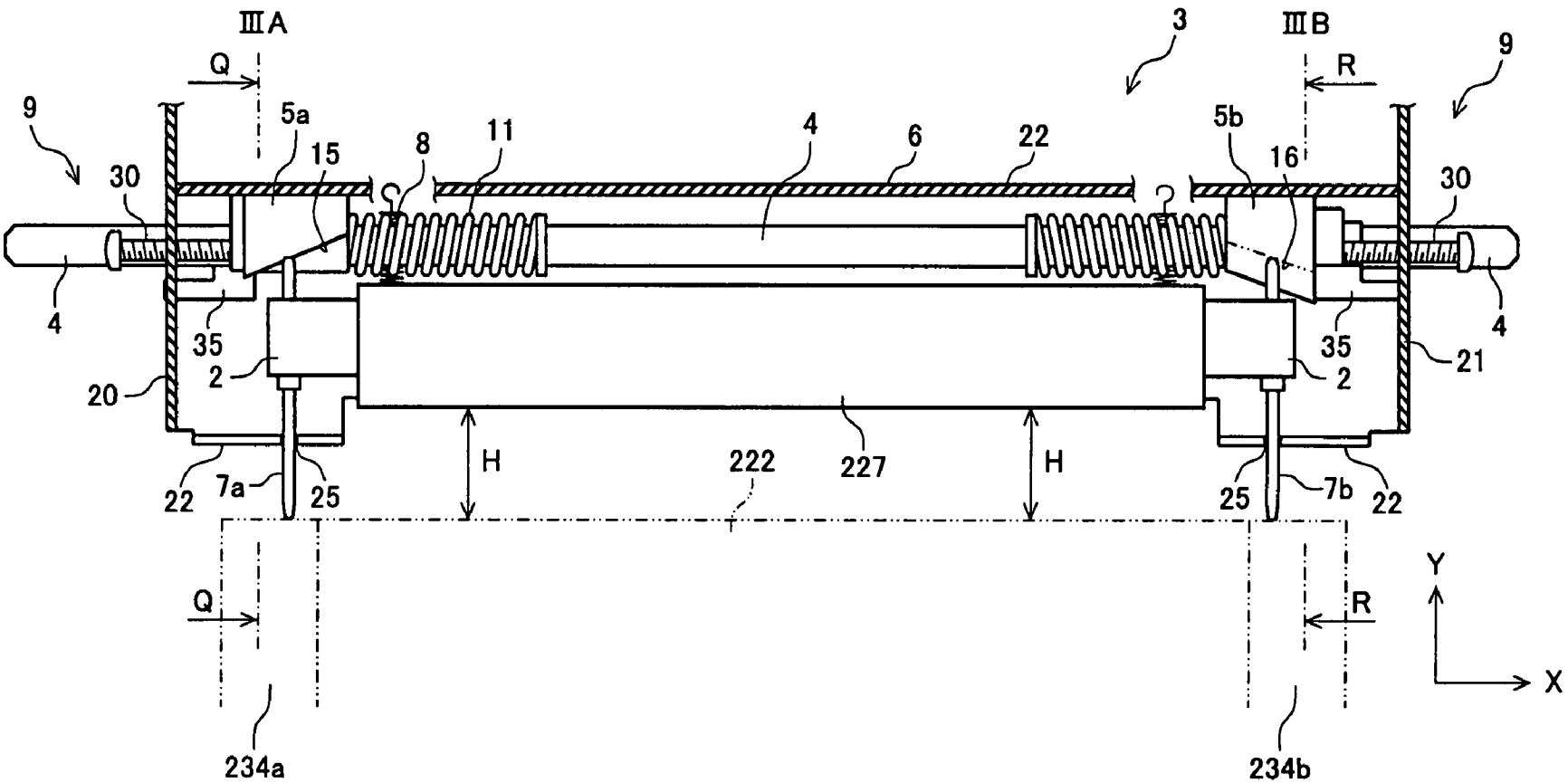
FIG. 2 is a sectional view of a write head adjustment apparatus in an image forming apparatus of a first embodiment, taken along line P-P of FIG. 1.
Figure 3A:
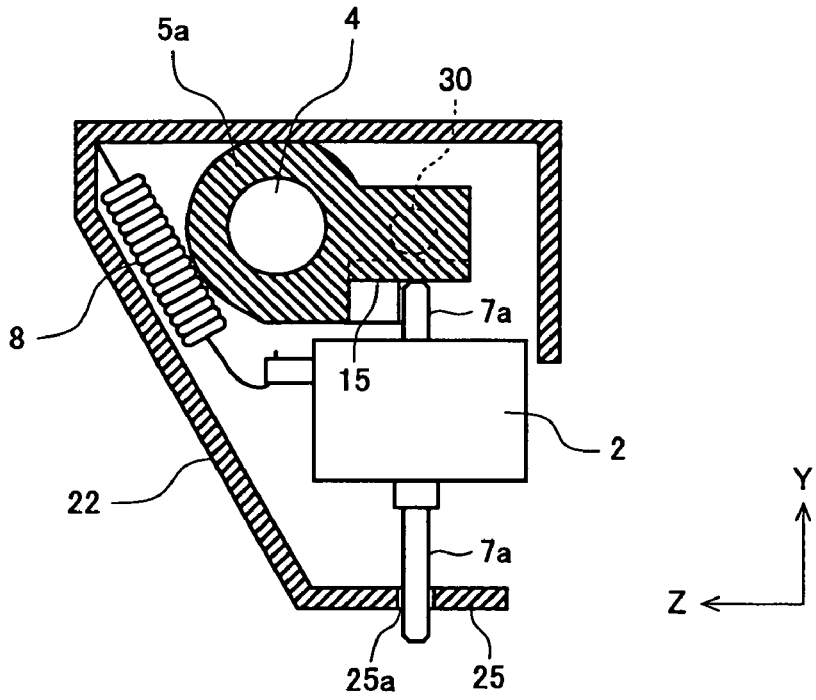
FIG. 3A is a sectional view of FIG. 2, taken along line Q-Q of FIG. 2.
Figure 3B:
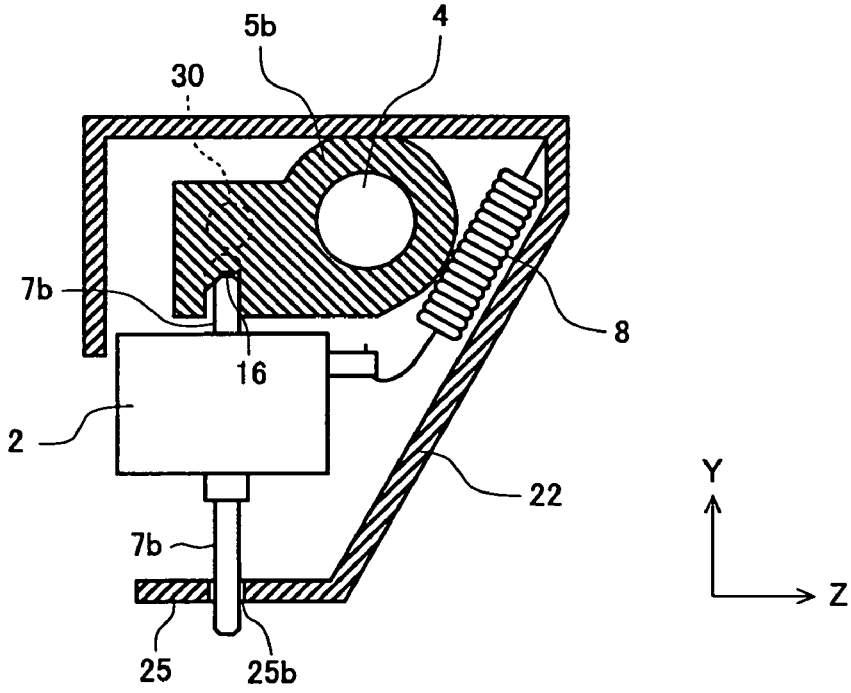
FIG. 3B is a sectional view of FIG. 2, taken along line R-R of FIG. 2.
Figure 4:
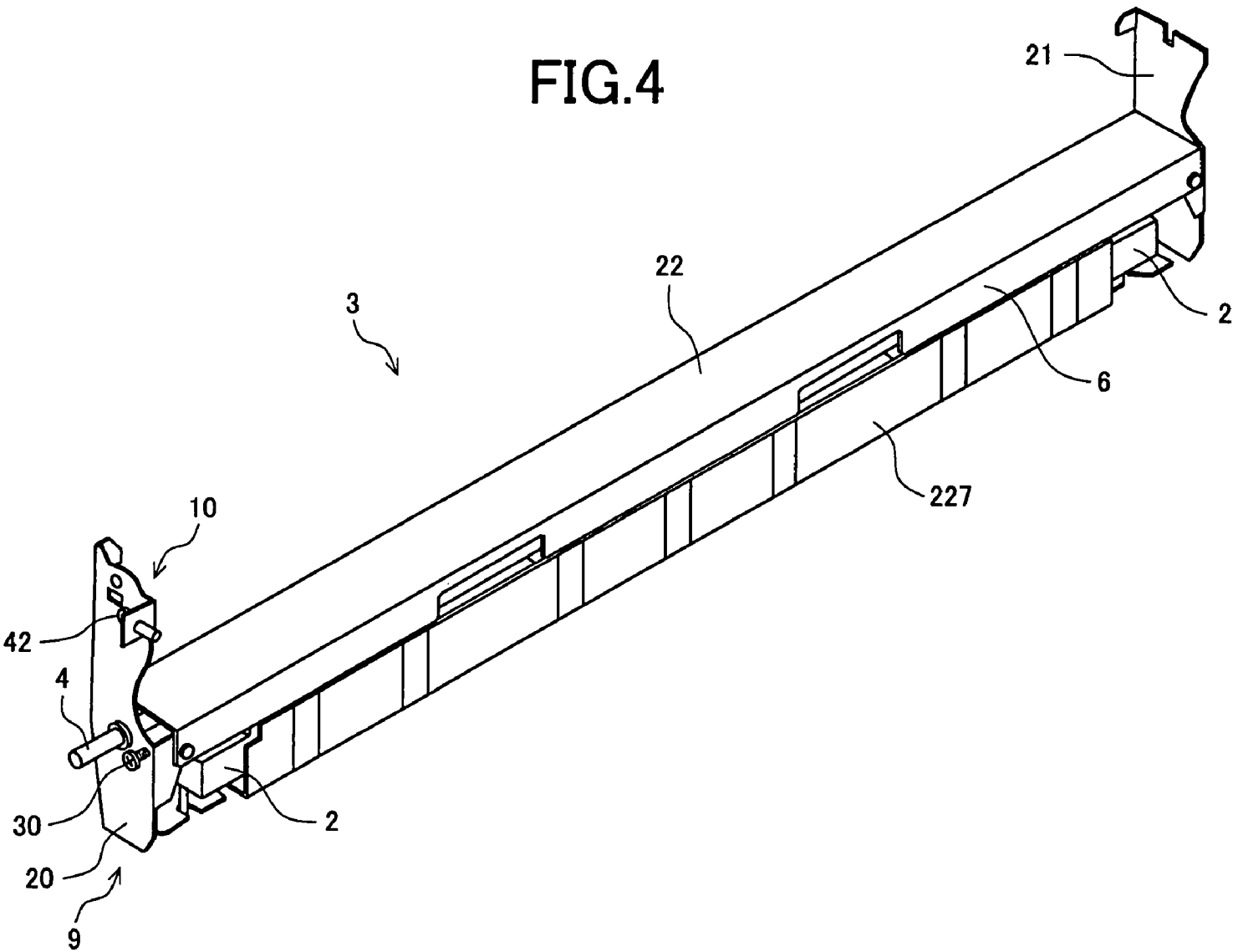
FIG. 4 is a perspective view of the write head adjustment apparatus.

FIG. 2 is a sectional view of a write head adjustment apparatus in an image forming apparatus of a first embodiment, taken along line P-P of FIG. 1. FIGS. 3A and 3B are sectional views of FIG. 2; FIG. 3A is taken along line Q-Q of FIG. 2; and FIG. 3B is taken along line R-R of FIG. 2. FIG. 4 is a perspective view of the write head adjustment apparatus. The write head adjustment apparatus 3 holds the LED head 227, adjusts the distance between the LED head 227 and the photoreceptor drum 222, and adjusts the scanning inclination of the LED head 227 relative to the photoreceptor drum 222. The adjustment of the scanning inclination is to adjust the longitudinal direction of the LED head 227 on a cylindrical surface around the rotation shaft of the photoreceptor drum 222 to become parallel to the axis direction of the photoreceptor drum 222. The both longitudinal ends of the write head adjustment apparatus 3 are attached to the frame of the image forming apparatus 1 supporting the photoreceptor drum 222.

The write head adjustment apparatus 3 includes a support shaft 4 located substantially in parallel with the photoreceptor drum 222, a moving member 5 that is movably disposed along the support shaft 4 to move substantially parallel to the axis of the photoreceptor drum 222, a frame member 6 supported by the support shaft 4 and including first to third frames 20 to 22, a regulating member 7 disposed at the both ends of the LED head 227 to contact with the moving member 5 and to move and contact to the non-photoreceptor area of the photoreceptor drum, and a spring 8 that energizes the regulating member 7 toward the moving member 5 and the frame member 6. The write head adjustment apparatus 3 includes a first adjusting mechanism 9 including an interval adjustment screw 30 near the frame of the image forming apparatus 1, i.e., at the both longitudinal ends of the frame member 6 to adjust an interval H between the LED head 227 and the photoreceptor drum 222, and one end of the apparatus 3 includes a second adjusting mechanism 10 including an adjustment screw 42 to adjust the scanning inclination of the LED head 227 relative to the photoreceptor drum 222.

In the following description, as shown in FIG. 2, the X-axis direction is the axis direction of the photoreceptor drum 222; the Y-axis direction is a direction perpendicular to the X-axis direction and is a direction from the axis of the photoreceptor drum 222 toward the moving member 5; and the Z-axis direction is a direction perpendicular to the X-axis direction and the Y-axis direction. In this embodiment, the X-axis and Y-axis directions are horizontal directions and the Z-axis direction is a vertical direction.

(First Adjusting Mechanism 9)

The regulating member 7 is fixed to the head supporting portion 2 at the both ends of the LED head 227, is a pin-shaped member extending in a direction perpendicular to the longitudinal direction (horizontal direction of FIG. 2) of the LED head 227, and is formed as a conductive member. The regulating member 7 extends in the Y-axis direction to contact with the moving member 5 at an upper end that is one end in the Y-axis direction and to penetrate the frame member 6 and contact with surfaces of non-photoreceptor application portions 234*a*, 234*b* of the photoreceptor drum 222 at a lower end that is the other end in the Y-axis direction. The regulating member 7 includes a first regulating member 7*a* disposed at one end of the LED head 227 and a second regulating member 7*b* disposed at the other end of the LED head 227.

If it is assumed that a reference interval A is an interval between the LED head 227 and the photoreceptor drum 222 held at the time of forming an image in the image forming apparatus and that H is an interval between the LED head 227 and the surface of the photoreceptor drum 222 when the lower end of the regulating member 7 contacts (touches) the surface of the photoreceptor drum 222, a predefined interval B for adjustment is selected to establish B=A−H.

The moving member 5 is disposed for both the first and second regulating members 7*a*, 7*b* disposed at the both ends of the LED head 227. The moving member 5 includes a first moving member 5*a* in contact with the first regulating member 7*a* disposed at one end of the LED head 227 and a second moving member 5*b* in contact with the second regulating member 7*b* disposed at the other end of the LED head 227. The moving member 5 is movably disposed substantially parallel to the axis of the photoreceptor drum 222 along the support shaft 4. Specifically, the first and second moving members 5*a*, 5*b* are disposed by inserting the support shaft 4 to them and are energized by springs 11 toward the both ends in the axis direction of the support shaft 4. The springs 11 are coil springs and are disposed by inserting the support shaft 4 to them.

The moving member 5 includes an inclined surface 15 inclined in the axis direction of the photoreceptor drum 222, i.e., the X-axis direction. The inclined surface 15 is formed on the moving member 5 toward the photoreceptor drum 222, i.e., on the lower portion of the moving member 5. In the first embodiment, the first moving member 5*a* and the second moving member 5*b* include the inclined surfaces 15 with different inclination directions. That is, the inclined surface 15 of the first moving member 5*a* is upwardly formed from one end toward the other end of the support shaft 4, and the inclined surface 15 of the second moving member 5*b* is upwardly formed from the other end toward one end of the support shaft 4. By disposing the inclined surfaces of the moving member 5 in this way, the LED head 227 can be stabilized in the X-axis direction.

In the first moving member 5*a*, the inclined surface 15 is formed to contact with the first regulating member 7*a* at one point. In the second moving member 5*b*, the second moving member 5*b* includes a recessed portion 16 in the lower portion to contact with the second regulating member 7*b* at two or more points and the inclined surface 15 is formed on the bottom of the recessed portion 16. In this embodiment, the recessed portion 16 is formed in a groove shape extended in the X-axis direction. By disposing the recessed portion 16 to contact with the second regulating member 7*b* in this way, the regulating member 7 can be positioned by the inclined surface 15 formed on the bottom of the recessed portion 16 and the side surfaces of the recessed portion 16.

The frame member 6 is disposed to cover the LED head 227. The frame member 6 includes a first frame 20 at one end in the longitudinal direction, a second frame 21 at the other end in the longitudinal direction, and a third frame 22 between the first frame and the second frame. The first to third frames 20 to 22 are integrally configured by bending one metal plate member. A through-hole is disposed in the both longitudinal ends of the frame member 6, i.e., the first frame 20 and the second frame 21, and the support shaft 4 is inserted through the through-holes to support the frame member 6.

The frame member 6 is rotatably supported by the support shaft 4. A locking portion 25 is disposed on the side of the frame member 6 facing to the photoreceptor drum 222, i.e., the lower portion of the frame member 6 and is in contact with the other end in the Y-axis direction (lower end) of the regulating member 7. The locking portion 25 is formed in the third frame 22. A first locking portion 25*a* is the locking portion 25 at one end of the frame member 6 in contact with the first regulating member 7*a* disposed at one end of the LED head 227, and a second locking portion 25*b* is the locking portion 25 at the other end of the frame member 6 in contact with the second regulating member 7*b* disposed at the other end of the LED head 227.

The first locking portion 25*a* and the second locking portion 25*b* have different shapes. The first locking portion 25*a* is configured by a substantially U-shaped cut having a fore-end in the Z-axis direction, and the lower end of the first regulating member 7*a* can be positioned in the Z-axis direction by the first locking portion 25*a*. The second locking portion 25*b* is configured by a wedge-shaped (substantially V-shaped) cut having a fore-end in the Z-axis direction, and the lower end of the second regulating member 7*b* can be positioned in the X-axis and Z-axis directions by the second locking portion 25*b*. Although the locking portion 25 is formed by a cut opened toward the front side of the write unit in this embodiment, the locking portion 25 may be formed by a through-hole or a recessed portion having a cut.

The regulating members 7*a*, 7*b* are pin-shaped conductive members, and the tips thereof contact (touch) the non-photoreceptor application portions 234*a*, 234*b* near both ends of the photoreceptor drum 222 during the adjustment process of the interval between the LED head 227 and the photoreceptor. The non-photoreceptor application portions 234*a*, 234*b* of the photoreceptor drum 222 are, for example, conductive portions without a photoreceptor layer in a photoreceptor retaining member retaining the photoreceptor layer and may be the rotation shaft of the photoreceptor drum. A contact (touch) detection mechanism can electrically detect whether the tip of the regulating member 7 comes in contact with the conductive portion of the surface of the photoreceptor drum 222.

Figure 6:
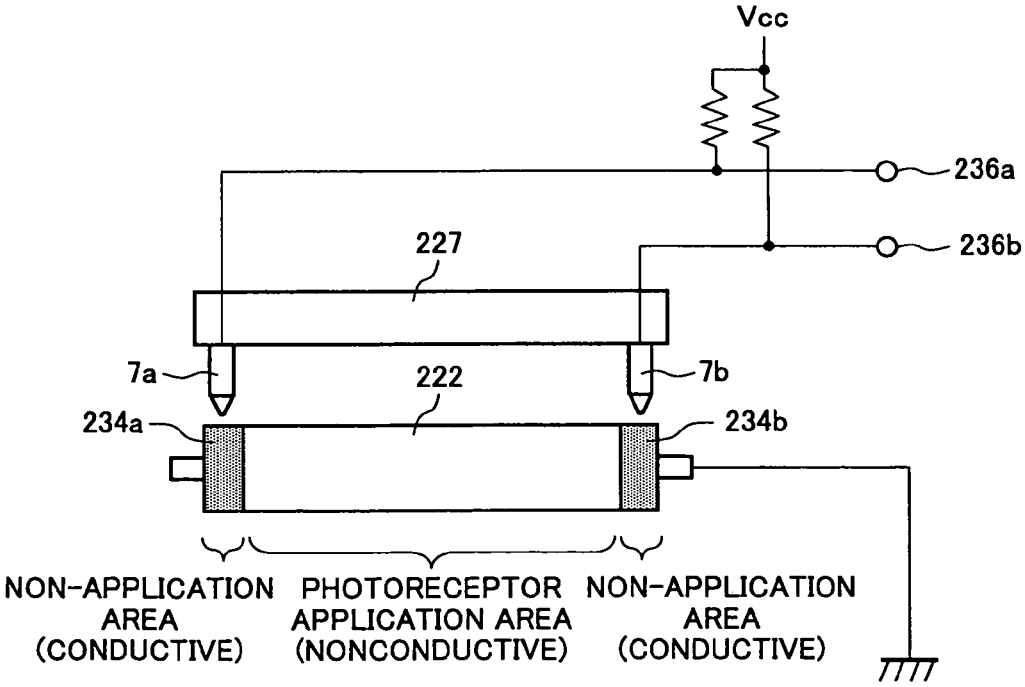
FIG. 6 depicts a contact detection mechanism.

FIG. 6 depicts the contact detection mechanism. The base consisting of an aluminum tube and the rotation shaft of the photoreceptor drum 222 are electrically connected, and if the tip of the regulating member 7 is not in contact with the non-photoreceptor application portion 234 on the surface of the photoreceptor drum 222, a high-level signal (voltage Vcc) is output to the output terminal 236. In the adjustment process of the LED head 227, if the tip of the regulating member 7 comes in contact with the non-photoreceptor application portion 234 of the photoreceptor drum 222, the output terminal 236 of the contact detection mechanism is grounded and a low-level signal (voltage 0) is output to the output terminal. The contact of the regulating members 7*a*, 7*b* and the surface of the photoreceptor drum 222 can be visually or auditorily notified by signals acquired from first and second output terminal 236*a*, 236*b* of the contact detection mechanism.

Description will be made of operation of adjusting the interval between the LED head 227 and the photoreceptor drum 222 with the write head adjustment apparatus 3. Although the following description is based on the adjustment operation using the first adjusting mechanism 9 at on end (front side) of the write head adjustment apparatus 3, the adjustment can be based on the first adjusting mechanism 9 at the other end (rear side) in exactly the same way.

FIGS. 7A to 7D depict a procedure of adjusting the interval between the write head and the photoreceptor in the image forming apparatus of the first embodiment; FIGS. 8A to 8D depict screens displayed on a display apparatus in the process of the interval adjustment shown in FIGS. 7A to 7D; a pin F represents the front regulating member 7*a*; a pin R represents the rear regulating member 7*b*; a symbol "○" indicates that the regulating member comes in contact with the photoreceptor drum; and a symbol "×" indicates that contact is not made.

Figure 7A:
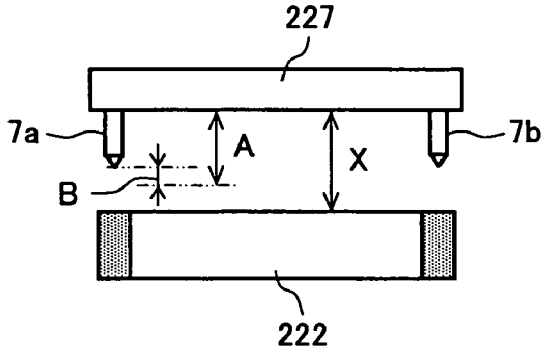
FIGS. 7A to 7D depict a procedure of adjusting an interval between the write head and the photoreceptor in the image forming apparatus of the first embodiment.

(First Process): To keep a substantially large interval between the LED head 227 and the surface of the photoreceptor drum 222 when adjusting the interval between the LED head 227 and the photoreceptor drum 222, the interval adjustment screw 30 is used to move the first moving member 5*a* and the second moving member 5*b* toward the end of the support shaft 4 to hold the LED head 227 at a high position. For example, as shown in FIG. 7A, an interval X between the LED head 227 and the surface of the photoreceptor drum 222 is made larger than a distance of a reference interval A. That is, the LED head 227 is moved away from the surface of the photoreceptor drum 222 by the reference interval A or more. The adjustment screen indicates that the regulating members 7*a*, 7*b* do not contact with the photoreceptor drum 222 as shown by "pin F: ×" and "pin R: ×" of FIG. 8A.

In the image forming apparatus of the first embodiment, a display apparatus including a liquid crystal panel, etc., located on the operation panel disposed in the image forming apparatus is used as a mechanism that visually displays when the first and second regulating members 7*a*, 7*b* comes in contact with the surface of the photoreceptor drum 222. The display apparatus shown in FIGS. 8A to 8D shows the adjustment screen on the liquid crystal panel on the operation panel in a mode of adjusting the interval between the LED head and the photoreceptor drum. In the first process, since both the first and second regulating members 7*a*, 7*b* do not contact (touch) the photoreceptor drum 222, the display indicates that both the first regulating member (front pin F) 7*a* and the second regulating member (rear pin R) 7*b* do not contact, as shown in FIG. 8.

Figure 7B:
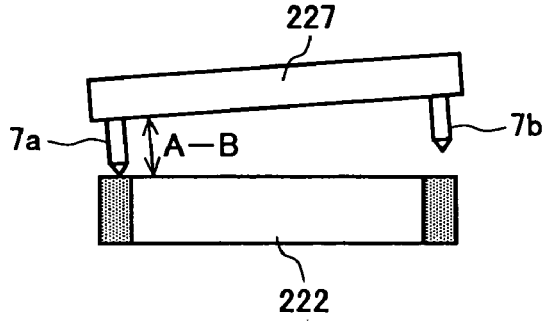

(Second Process): In FIG. 2, the interval adjustment screw 30 is used to move the first moving member 5*a* toward the center of the support shaft 4; the first regulating member 7*a* is moved closer to the photoreceptor drum 222; and the tip of the first regulating member 7*a* comes in contact with the non-photoreceptor application portion 234*a* of the photoreceptor drum 222. As shown in FIG. 7B, the interval between the LED head 227 and the photoreceptor drum 222 surface is H=A−B on the side of the first moving member 5*a* at this moment and is smaller than the desired reference interval A by a predetermined value B. Since the first regulating member 7*a* projecting from one end of the LED head 227 contacts with the photoreceptor drum 222 and the second regulating member 7*b* projecting from the other end of the LED head 227 does not contact with the photoreceptor drum 222, the operation panel displays "pin F: ○" and "pin R: ×" as shown in FIG. 8B.

Figure 7C:
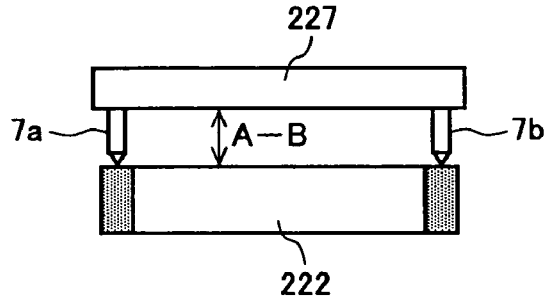

(Third Process): Similarly to the second process, the interval adjustment screw 30 is used to move the second moving member 5*b* toward the center of the support shaft 4; the second regulating member 7*b* is moved closer to the photoreceptor drum 222; and the tip of the second regulating member 7*b* comes in contact with the non-photoreceptor application portion 234*b* of the photoreceptor drum 222. As shown in FIG. 7C, the interval between the LED head 227 and the photoreceptor drum 222 surface is H=A−B on the side of the second moving member 5*b* at this moment and is smaller than the reference interval A by the predetermined value B, and the interval between the LED head 227 and the photoreceptor drum 222 surface is A-B over the entire length. Since both the first and second regulating members 7*a*, 7*b* contact with the photoreceptor drum 222 in this state, the operation panel displays "pin F: ○" and "pin R: ○" as shown in FIG. 8C. As described above, the second process and the third process may be performed in reverse order.

(Fourth Process): The interval between the LED head 227 and the photoreceptor drum 222 surface is A-B over the entire length as a result of the operation to the third process and is smaller than a design value, i.e., the reference interval A by the distance B. Therefore, the LED head 227 is moved away from the photoreceptor drum 222 by the distance B until the desired reference interval A can be acquired. The interval adjustment screw 30 is tightened again to move the first moving member 5*a* of the LED head 227 toward the end of the support shaft 4 (to the left of FIG. 2) and the interval adjustment screw 30 is tightened again to move the second moving member 5*b* at the other end toward the end of the support shaft 4 (to the right of FIG. 2).

Figure 7D:
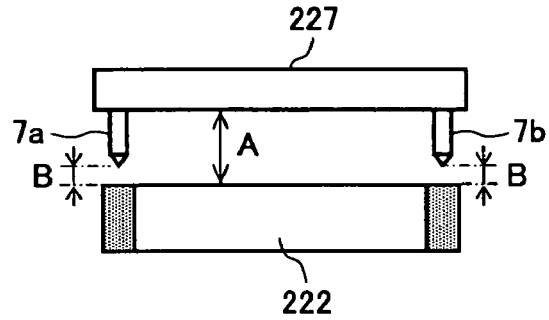

In the fourth process, the amount of the tightening of the interval adjustment screw 30 is calculated based on an adjustment interval length B, the shapes of the first and second moving members 5*a*, 5*b* (degree of inclination), and screw pitches of first and second interval adjustment screws 9*a*, 9*b* and, for example, the amount is determined as tightening of the interval adjustment screw 9 by half turn, one turn, etc. For example, if one turn of the first and second interval adjustment screws 9*a*, 9*b* corresponds to a moving distance of 0.2 mm, the process can be achieved by defining the distance B as 0.2 mm. When the fourth process is completed, as shown in FIG. 7D, the LED head 227 is away from the photoreceptor drum 222 by the distance A over the entire length. Since both the first and second regulating members 7*a*, 7*b* do not contact with the photoreceptor drum 222, the operation panel displays "pin F: ×" and "pin R: ×" as shown in FIG. 8D. The operation of separating the first and second regulating members 7*a*, 7*b* may be performed in reverse order.

Figure 9:
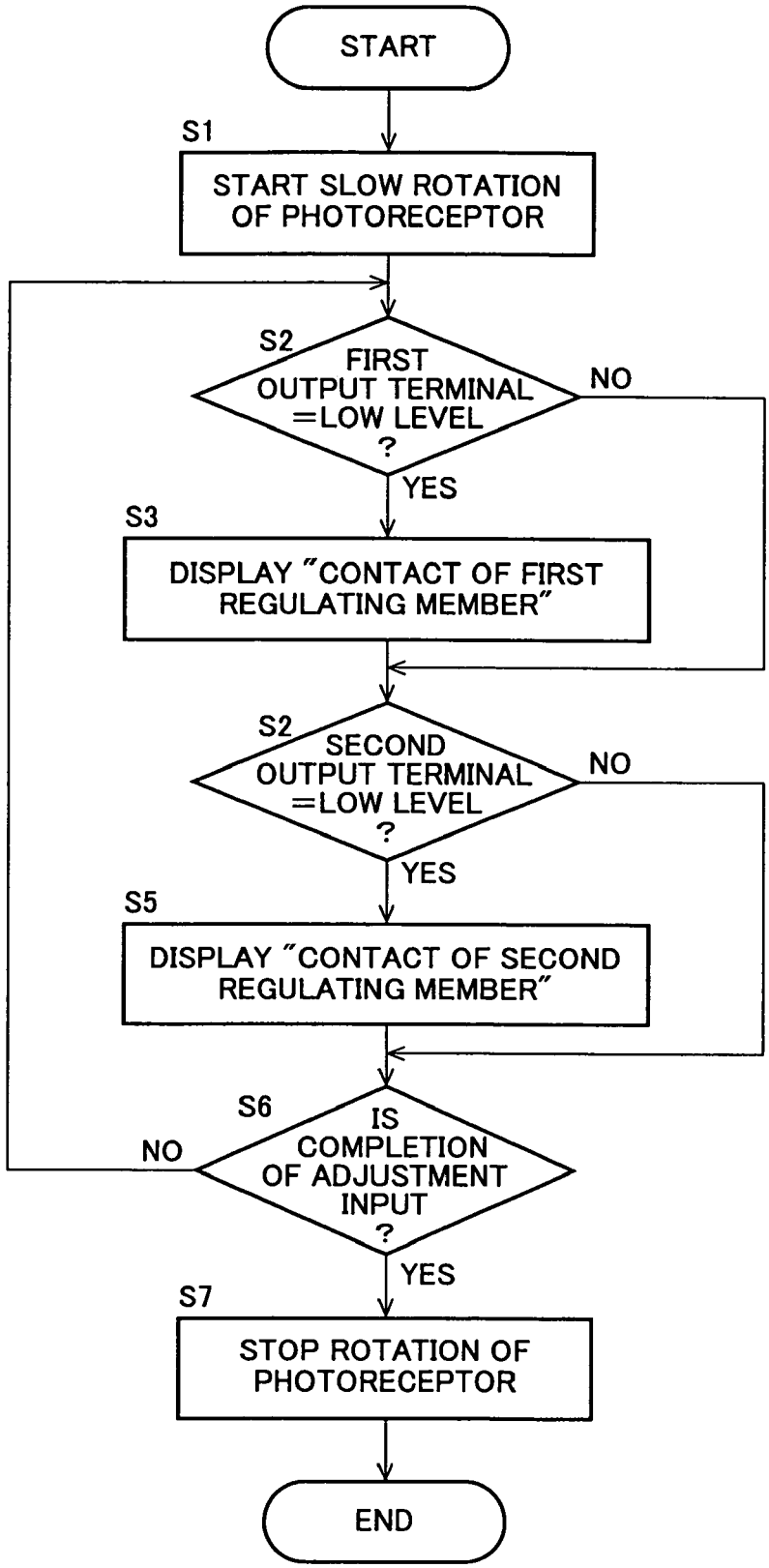
FIG. 9 is a flowchart of a process when adjusting the interval between the write head and the photoreceptor in the image forming apparatus of the first embodiment.

FIG. 9 is a flowchart of a process when adjusting the interval between the write head and the photoreceptor in the image forming apparatus of the first embodiment.

After the operation mode of the image forming apparatus is set to a mode of adjusting the interval between the write head 227 and the photoreceptor, the photoreceptor drum 222 is rotated at a low speed (step 1). The first regulating member 7*a* is moved closer toward the surface of the photoreceptor drum 222; it is checked whether the output of the first output terminal 236*a* of the contact detection mechanism is the low-level signal (step 2); if the output is the low-level signal, the display portion of the operation panel displays that the first regulating member 7*a* comes in contact with the non-photoreceptor application portion 234*a* of the photoreceptor drum 222 as shown in FIG. 8B (step 3); and it is then checked whether the output of the second output terminal 236*b* of the contact detection mechanism is the low-level signal (step 4).

If the output of the second output terminal 236*b* is the low-level signal at step 4, the display portion of the operation panel displays that the second regulating member 7*b* comes in contact with the non-photoreceptor application portion 234*b* of the photoreceptor drum 222 as shown in FIG. 8C (step 5). When the output of both the first and second output terminals 236*a*, 236*b* becomes the low-level signal and the first half of the adjustment operation is completed (step 6), the rotation of the photoreceptor drum 222 is stopped (step 7), and the interval adjustment screws 30, 30 are tightened again by an amount corresponding to the distance B to terminate the process. If the output of the first and second output terminals is not the low-level signal at steps 2 and 4, since the display as shown in FIGS. 8B and 8C is not performed and the adjustment input is not completed at step 6, the procedure goes back to step 2 to repeat the same process.

In the course of the above process, since the photoreceptor drum 222 is rotated at a low speed during the adjustment process, the tips of the first and second regulating members 7*a*, 7*b* come in contact with conductive areas without the photoreceptor layer (non-photoreceptor application portions 234*a*, 234*b*) of the photoreceptor drum and can remove oxide, etc., from the contact surface to prevent contact failure.

(Second Adjusting Mechanism 10)

Figure 10:
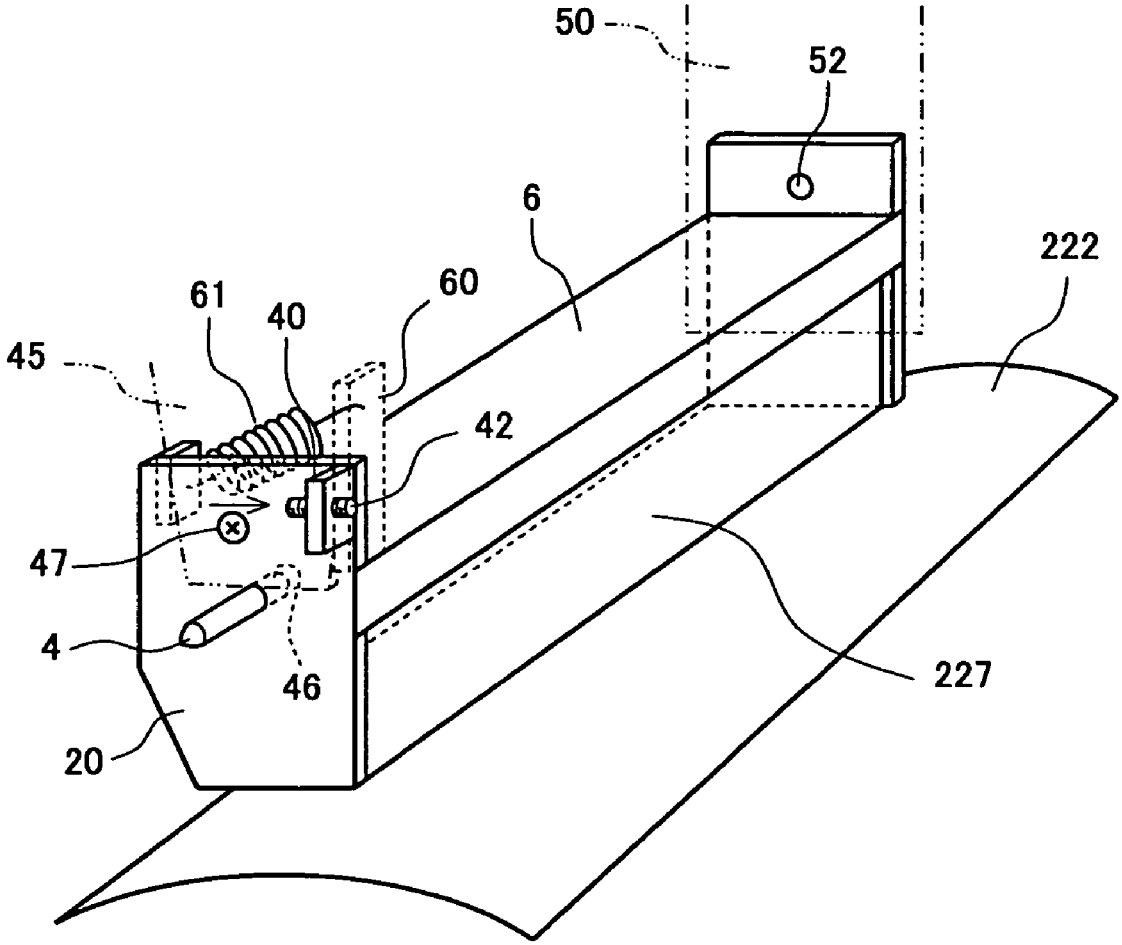
FIG. 10 is a perspective view of a second adjusting mechanism that adjusts, the scanning inclination of the write head.
Figure 11A:
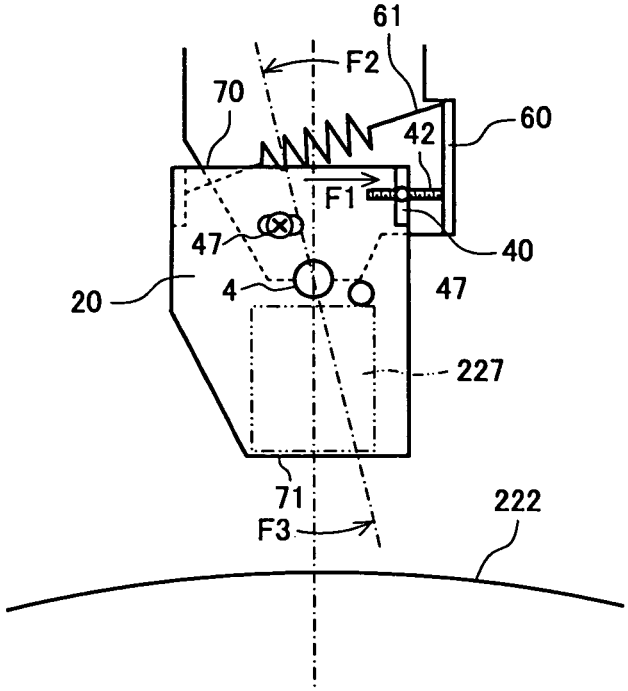
FIG. 11A is a side view of a write unit disposed on a body frame, depicting movement when adjusting the scanning inclination.
Figure 11B:
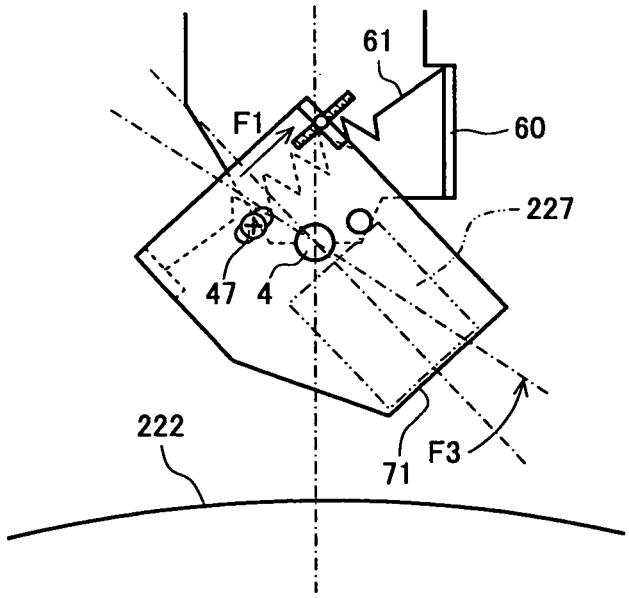
FIG. 11B is a side view of the write unit disposed on the body frame, depicting movement when the adjusting mechanism is evacuated.

FIG. 10 is a perspective view of a second adjusting mechanism that adjusts the scanning inclination of the write head; FIGS. 1A and 11B are side views of the write unit disposed on a body frame; FIG. 11A depicts movement when adjusting the scanning inclination; and FIG. 11B depicts movement when the adjusting mechanism is evacuated. The second adjusting mechanism 10 is a mechanism that adjusts the scanning inclination of the LED head 227 relative to the photoreceptor drum 222, and a first body frame 45 includes a frame projecting portion 60 that projects outwardly to be opposed to a support plate 40 of the frame member 6. The frame projecting portion 60 may be integrally configured with the first body frame 45, and a spring 61 is attached to the frame projecting portion 60 and energizes the frame member 6 in a predetermined direction. The spring 61 disposed on the frame projecting portion 60 of the first body frame 45 energizes the tip of the scanning inclination adjustment screw 42 toward the frame projecting portion 60.

Description will be made of the adjustment of the scanning inclination of the LED head 227 relative to the photoreceptor drum 222 with the use of the second adjusting mechanism 10. While the other end of the frame member 6 is fixed to the second body frame 50, a first fixing screw 47 is loosened which fixes one end of the frame member 6 to the first body frame 45. If the scanning inclination adjustment screw 42 is rotated and advanced toward the frame projecting portion 60, the scanning inclination adjustment screw 42 is blocked by the frame projecting portion 60, and an upper end 70 of the frame member 6 is subjected to the action in the direction departing from the frame projecting portion 60. Since the frame member 6 is rotatably supported by the support shaft 4, the frame member 6 is torsionally rotated around the support shaft 4 and a lower end 71 of the frame member 6 is subjected to a rotation force in a direction of an arrow F3 of FIG. 11A. As a result, the frame member 6 is twisted around the support shaft 4.

When the frame member 6 is torsionally rotated, the LED head 227 held within the frame member 6 swings and rotates around the reference side, which is the side of the second regulating member 7*b*. Therefore, the longitudinal direction of the LED head 227 can be made parallel to the axis direction of the photoreceptor drum 222 on a cylindrical surface around the axis of the photoreceptor drum 222. Although the case of advancing the scanning inclination adjustment screw 42 in the arrow F1 direction has been described, if the scanning inclination adjustment screw 42 is moved in the counter direction of the arrow F1 direction, the frame member 6 can inversely be twisted. By torsionally rotating the frame member 6 around the support shaft 4 as above, the second adjusting mechanism 10 can make the longitudinal direction of the LED head 227 parallel to the axis direction of the photoreceptor drum 222 on a cylindrical surface around the axis of the photoreceptor drum 222 and can adjust the scanning inclination of the LED head 227 relative to the photoreceptor drum 222.

Since the support shaft 4 rotatably supports the frame member 6 (the first to third frames 20 to 22) holding the write head adjustment apparatus 3 in the first embodiment, a manual lever can be attached to the support shaft 4 to manually rotate to an appropriate angle against the energizing force of the spring 61.

Figure 12A:
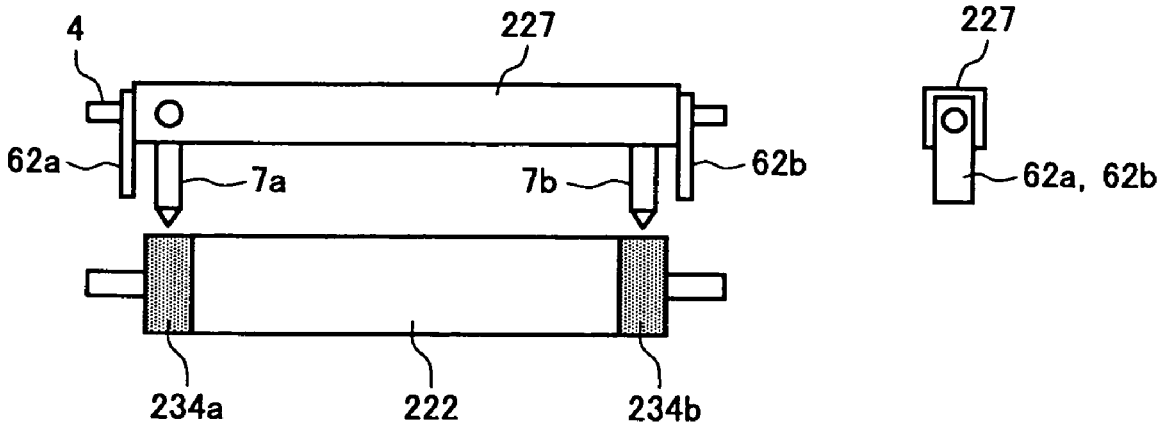
FIG. 12A depicts how the write head adjustment apparatus is rotated and evacuated around a support shaft when the interval between the write head and the photoreceptor drum surface is adjusted.
Figure 12B:
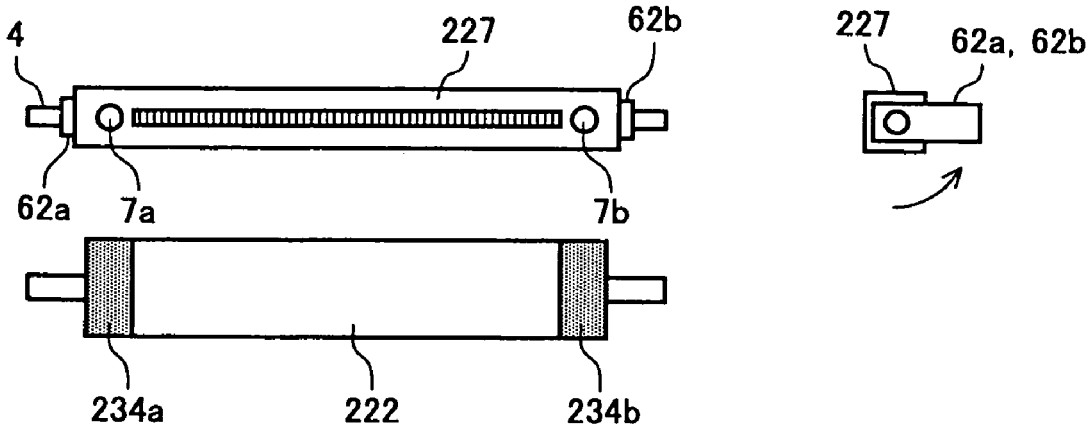
FIG. 12B depicts how the write head adjustment apparatus is rotated and evacuated around the support shaft when the interval between the write head and the photoreceptor drum surface is not adjusted.

FIGS. 12A and 12B depict how the write head adjustment apparatus is rotated and evacuated around the support shaft; FIG. 12A is in the case of adjusting the interval between the write head and the photoreceptor drum surface; FIG. 12B is in the case of not adjusting the interval. As described above, the write head adjustment apparatus of the embodiment includes the first and second regulating members 7*a*, 7*b* at the head supporting portion 2 of the LED head 227, and the intervals between the lower ends of the first and second regulating members 7*a*, 7*b* and the photoreceptor drum surface are considerably smaller than the interval between the LED head and the photoreceptor drum. Therefore, at the time of the operation of removing the photoreceptor drum and mounting the new photoreceptor drum 222 when replacing the photoreceptor drum, if the photoreceptor drum comes in contact with the first and second regulating members 7*a*, 7*b*, the photoreceptor layer of the photoreceptor drum 222 surface is damaged and/or the regulating member 7 is deformed.

Therefore, if the photoreceptor drum 222 is replaced in the write head adjustment apparatus in the first embodiment, the write head adjustment apparatus located as shown in FIG. 12A is rotated to an appropriate angle (e.g., 90 degrees) as shown in FIG. 12B. A mechanism of rotating the write head adjustment apparatus may be electrically or manually operated, and can simply be realized by attaching a manual lever 62*a*, 62*b* to both or one end of the support shaft 4 to manually rotate and drive the support shaft 4. As a result, when the write head adjustment apparatus is moved to a raised position by the manual lever 62 and is retained at the position by, for example, locking the manual lever 62 to the body frame, the space below the write head adjustment apparatus is wide open, and the damage of the photoreceptor layer of the photoreceptor drum 222 surface and the deformation of the regulating member 7 can be avoided at the time of removing and mounting the photoreceptor drum.

Second Embodiment

FIGS. 13A to 13D depict a procedure of adjusting the interval between the write head and the photoreceptor in an image forming apparatus of a second embodiment. In the image forming apparatus of the first embodiment, after the regulating members 7*a*, 7*b* come in contact with the non-photoreceptor application portions 234*a*, 234*b* of the photoreceptor drum, the regulating member 7 is moved together with the LED head 227 in the direction away from the photoreceptor by the predetermined interval (B). On the other hand, the image forming apparatus of the second embodiment includes a mechanism that mounts spacers 235*a*, 235*b* with a thickness (B) corresponding to the predetermined interval described in the image forming apparatus of the first embodiment to a position corresponding to the non-photoreceptor application portion 234 on the photoreceptor drum; a moving mechanism that integrally moves the first and second regulating members 7*a*, 7*b* with the write head toward the photoreceptor to come in contact with the spacers 235*a*, 235*b*; and a mechanism that removes the spacers 235*a*, 235*b* after the regulating members 7*a*, 7*b* come in contact with the spacers 235*a*, 235*b*. The contact detection mechanism shown in FIG. 6 can detect whether the first and second regulating members 7*a*, 7*b* come in contact with the spacers 235*a*, 235*b*.

FIGS. 14A to 14D depict screens displayed on the display apparatus in the process of adjusting the interval between the write head and the photoreceptor; a symbol "○" indicates that the regulating member 7 (7*a*, 7*b*) comes in contact with the spacer 235 (235*a*, 235*b*); and a symbol "×" indicates that contact is not made. In the following description, constituent elements in common with the image forming apparatus of the first embodiment will not be shown and described.

Figure 13A:
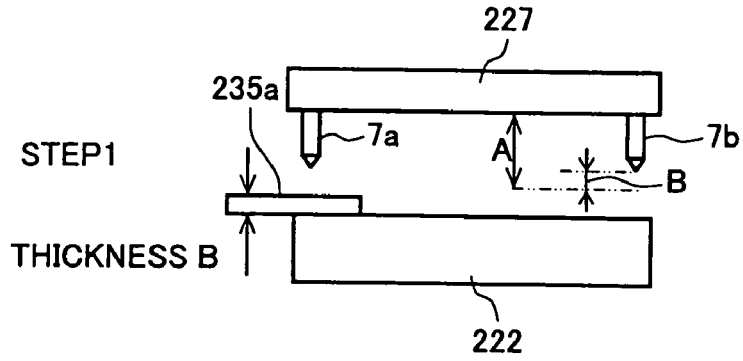
FIGS. 13A to 13D depict a procedure of adjusting the interval between the write head and the photoreceptor in an image forming apparatus of a second embodiment.

(First Process): To keep a substantially large interval between the LED head 227 and the surface of the photoreceptor drum 222 when adjusting the interval between the LED head 227 and the photoreceptor drum 222, the interval adjustment screw 30 is used to move the first moving member 5*a* and the second moving member 5*b* toward the ends of the support shaft 4 to hold the LED head 227 at an upper position as shown in FIG. 13A, and the spacer mounting mechanism mounts the spacer 235*a* with the thickness (B) to the left end of the photoreceptor drum 222. In the first process, since the first regulating member 7*a* does not contact with the spacer 235*a* and the second regulating member 7*b* does not contact with the spacer 235*b*, the adjustment screen displays "pin F: ×" and "pin R: ×" as shown in FIG. 14A.

Figure 13B:
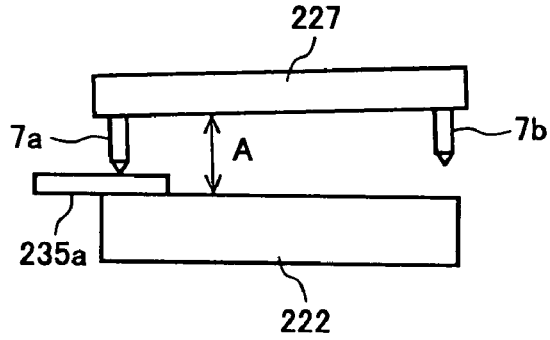

(Second Process): The interval adjustment screw 30 is used to move the first moving member 5*a* toward the center of the support shaft 4; the first regulating member 7*a* is moved closer to the photoreceptor drum 222; and the tip of the first regulating member 7*a* comes in contact with the spacer 235*a* as shown in FIG. 13B. The interval between the LED head 227 and the photoreceptor drum 222 surface is the desired reference interval A on the side of the first moving member 5*a* at this moment because of the intervention of the spacer 235*a* with the thickness (B). Since the first regulating member 7*a* contacts with the spacer 235*a* and the second regulating member 7*b* does not contact with the spacer 235*b*, the liquid crystal panel displays "pin F: ○" and, "pin R: ×" as shown in FIG. 14B. Then, the spacer removing mechanism removes the spacer 235*a*.

Figure 13C:
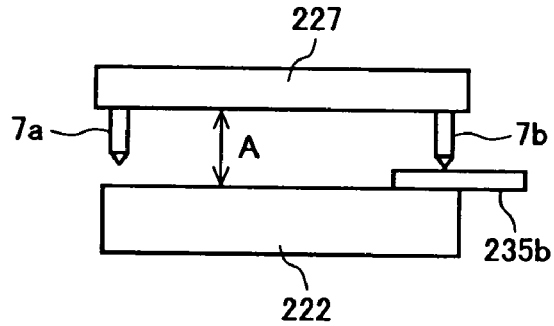

(Third Process): After the spacer mounting mechanism mounts the spacer 235*b* to the right end of the photoreceptor drum 222, the interval adjustment screw 30 is used to move the second moving member 5*b* toward the center of the support shaft 4; the second regulating member 7*b* is moved closer to the spacer 235*b*; and the tip of the second regulating member 7*b* comes in contact with the spacer 235*b* as shown in FIG. 13C. Since the first regulating member 7*a* does not contact with the spacer 235*a* and the second regulating member 7*b* contacts with the spacer 235*b*, the liquid crystal panel displays "pin F: ×" and "pin R: ○" as shown in FIG. 14C. The interval between the LED head 227 and the photoreceptor drum 222 surface is the desired reference interval A on the side of the second moving member 5*b* at this moment. The second process and the third process may be performed in reverse order.

Figure 13D:
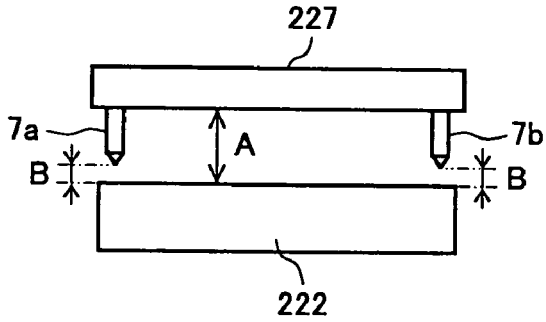

(Fourth Process): The spacer removing mechanism removes the spacer 235*b*. The spacers 235*a*, 235*b* are removed as above and the interval between the LED head 227 and the photoreceptor drum 222 surface becomes the reference interval A across the full width as shown in FIG. 13D. Since the first regulating member 7*a* does not contact with the spacer 235*a* and the second regulating member 7*b* does not contact with the spacer 235*b*, the liquid crystal panel displays "pin F: ×" and "pin R: ×" as shown in FIG. 14D.

Third Embodiment

An image forming apparatus of a third embodiment relates to adjustment of the mounting position of the write head when eccentricity is generated in the photoreceptor drum 222 for some reason and the interval between the write head 227 and the photoreceptor drum 222 fluctuates periodically in one rotation of the photoreceptor drum. Although it is desirable that the interval between the write head 227 and the photoreceptor drum 222 is not fluctuated during one rotation of the photoreceptor drum 222, if the fluctuation range falls within a predetermined range, the photoreceptor drum 222 can be used to acquire a predetermined image quality.

Figure 15A:
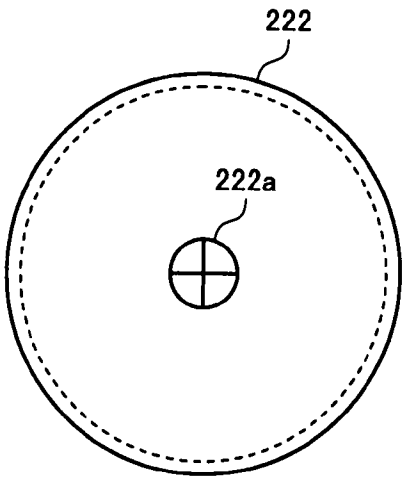
FIGS. 15A to 15C depict defective shapes generated in the photoreceptor drum.
Figure 15B:
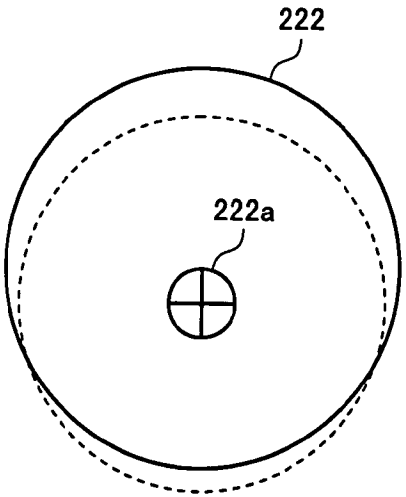
Figure 15C:
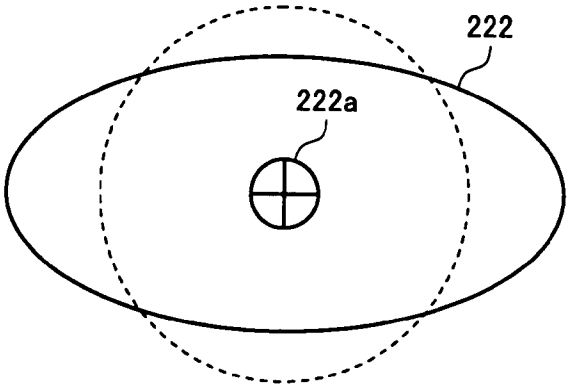

FIGS. 15A to 15C depict defective shapes generated in the photoreceptor drum. In the case of the defective shape generated in the photoreceptor drum of FIG. 15A, although the diameter of the photoreceptor drum 222 should be an ideal shape shown by a dotted line, the diameter is larger (or smaller) as shown by a solid line and does not fall within a predetermined tolerance, and the photoreceptor drum 222 cannot be used in the image forming apparatus in this case. In the case of FIG. 15B, since a drum rotation shaft 222*a* is eccentrically attached to the photoreceptor drum 222, regular fluctuations are generated in one rotation of the photoreceptor drum 222. In the case of FIG. 15C, since the photoreceptor drum 222 is deformed, the photoreceptor drum 222 is fluctuated in one rotation and if the photoreceptor drum 222 is deformed into a shape of an ellipse as shown, the frequency of fluctuation becomes a half of the case of FIG. 15B.

In the case of FIGS. 15B and 15C, the write head 227 must be adjusted and mounted such that the interval between the write head 227 and the photoreceptor drum 222 does not become too large or too small during one rotation of the photoreceptor drum 222. That is, when the interval adjustment is performed between the write head 227 and the photoreceptor drum 222, the position of the photoreceptor drum 222 must be an intermediate position between the position of the maximum interval and the position of the minimum interval.

Figure 16:
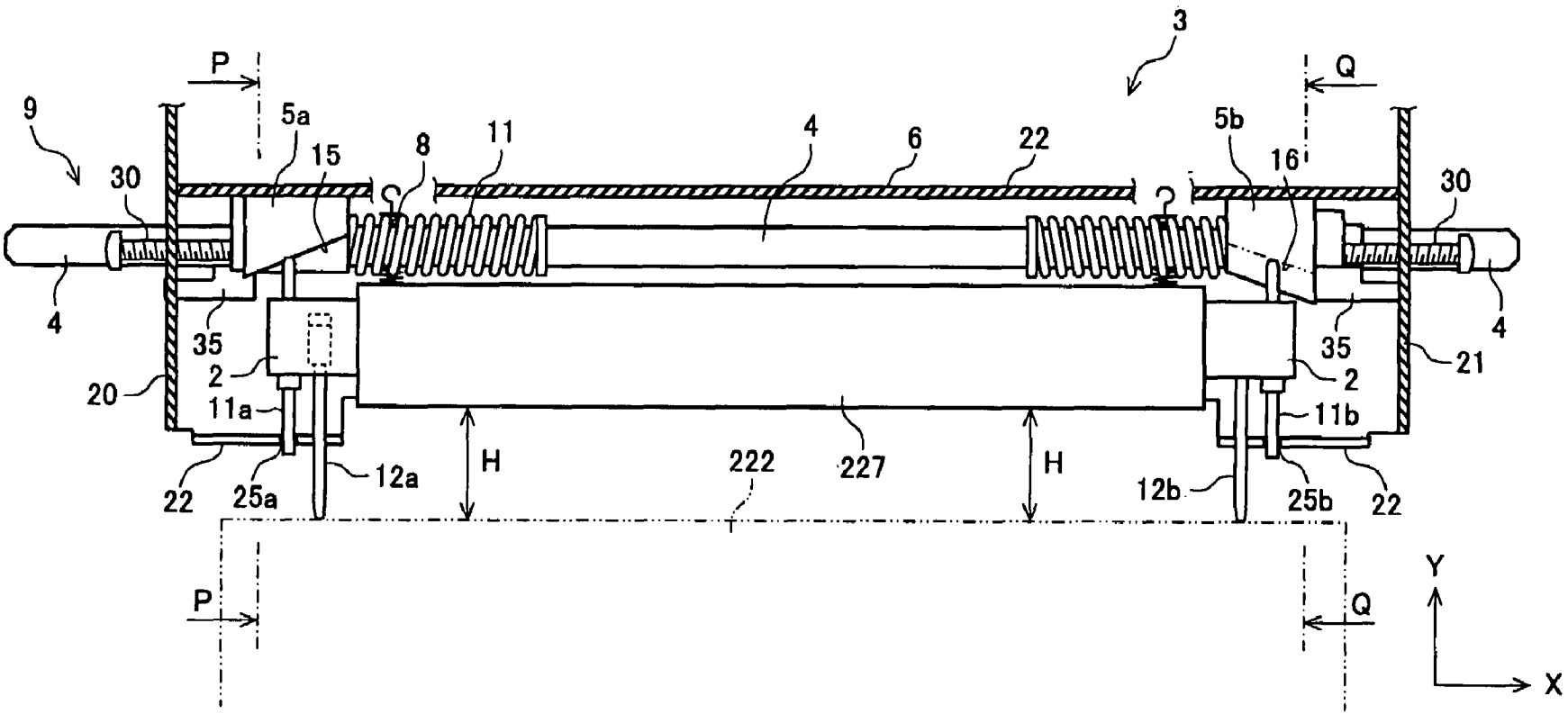
FIG. 16 is a sectional view of a write head adjustment apparatus in an image forming apparatus of a third embodiment, taken along line P-P of FIG. 1.

FIG. 16 is a sectional view of a write head adjustment apparatus in the image forming apparatus of the third embodiment, taken along line P-P of FIG. 1. Since the image formation apparatus of the third embodiment is based on an image forming portion that has the same configuration as the image forming portion of the image formation apparatus of the first embodiment shown in FIGS. 1 and 2, configurations of other portions will mainly be described.

The write head adjustment apparatus 3 shown in FIG. 16 includes the support shaft 4 located substantially in parallel with the photoreceptor drum 222, the moving member 5 that is movably disposed along the support shaft 4 to move substantially parallel to the axis of the photoreceptor drum 222, the frame member 6 supported by the support shaft 4 and including the first to third frames 20 to 22, moving guide pins 21*a*, 11*b* disposed at both ends of the LED head 227, which is in contact with the moving member 5, and which is locked and guided by the first locking portions 25*a*, 25*b* of the third frame 22, and the spring 8 that energizes the moving guide pins 11*a*, 11*b* toward the moving member 5 and the frame member 6. The write head adjustment apparatus 3 includes the first adjusting mechanism 9 including the interval adjustment screw 30 near the frame of the image forming apparatus 1, i.e., at the both longitudinal ends of the frame member 6 to adjust the interval H between the LED head 227 and the photoreceptor drum 222, and the second adjusting mechanism 10 including the scanning inclination adjustment screw to adjust the scanning inclination of the LED head 227 relative to the photoreceptor drum 222. The head supporting portion 2 of the LED head 227 is disposed with movable pins 12*a*, 12*b* that can freely move in the axis direction, adjacent to the moving guide pins 11*a*, 11*b*.

Figure 17A:
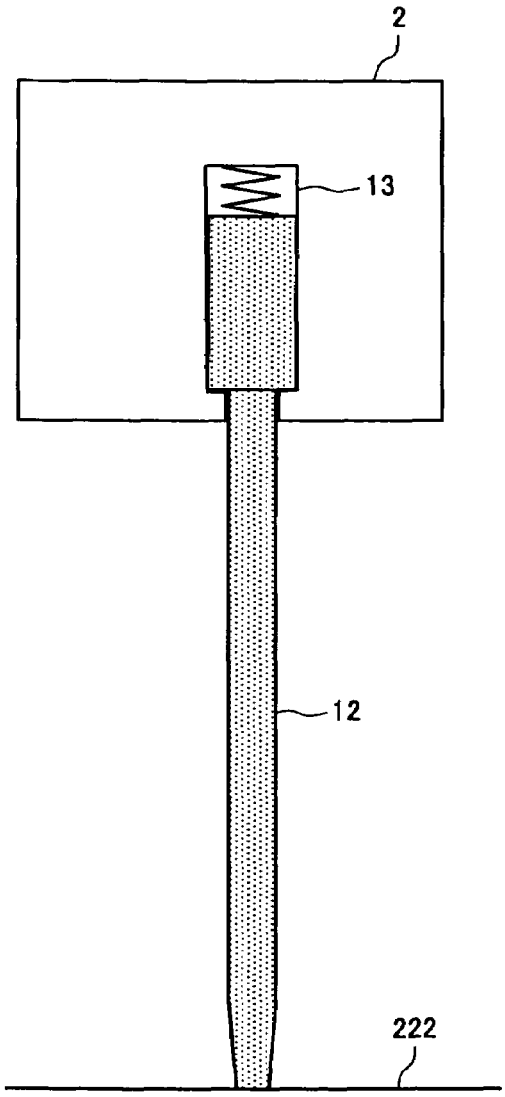
FIGS. 17A and 17B depict a configuration of a movable pin and a relationship between the movable pin and the photoreceptor drum surface.
Figure 17B:
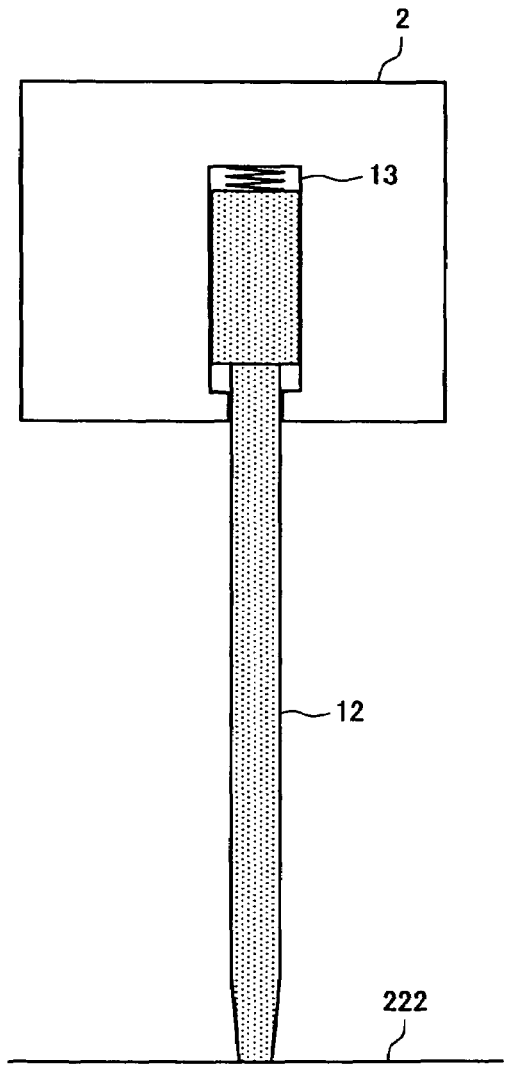

FIGS. 17A and 17B depict a configuration of the movable pin and a relationship between the movable pin and the photoreceptor drum surface. The movable pin 12*a*, 12*b* is formed as a conductive member, and the upper expanded portion thereof is mounted to a movable pin mounting portion 13 formed in the head supporting portion 2 of the LED head 227 by a spring and is energized in the protruding direction. The length of the movable pin 12*a*, 12*b* is set such that the interval between the LED head 227 and the photoreceptor drum 222 surface becomes A-B when the pin protrudes to a maximum extent as shown in FIG. 17A. Therefore, the movable pin 12*a*, 12*b* can move depending on the position of the photoreceptor drum 222 surface (interval between the LED head 227 and the photoreceptor drum 222 surface), and the tip thereof is in contact with the non-photoreceptor application portion of the photoreceptor drum 222 as shown in FIG. 17A or 17B. The contact detection mechanism shown in FIG. 6 can be used to detect whether the movable pin 12*a*, 12*b* comes in contact with the non-photoreceptor application portion of the photoreceptor drum 222.

Figure 18A:
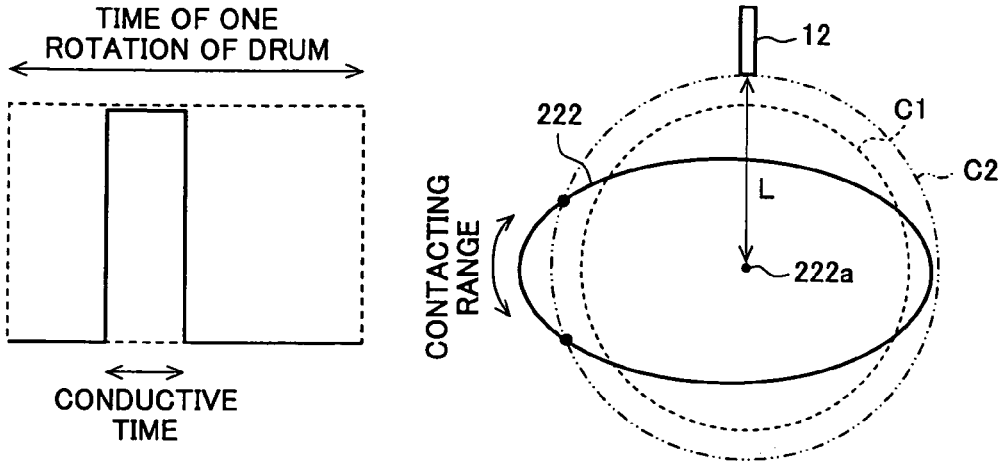
FIGS. 18A to 18C depict a method of adjusting amounting position of the write head in the image forming apparatus of the third embodiment.
Figure 18B:
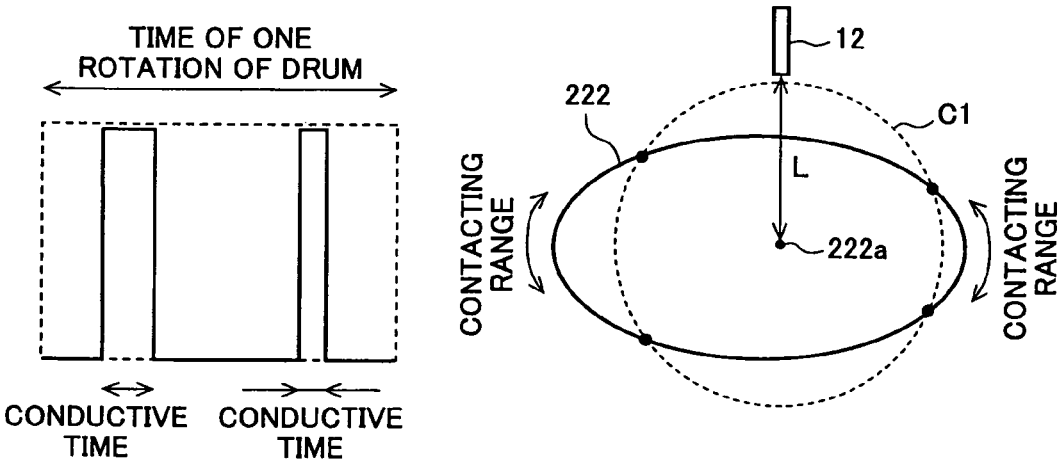
Figure 18C:
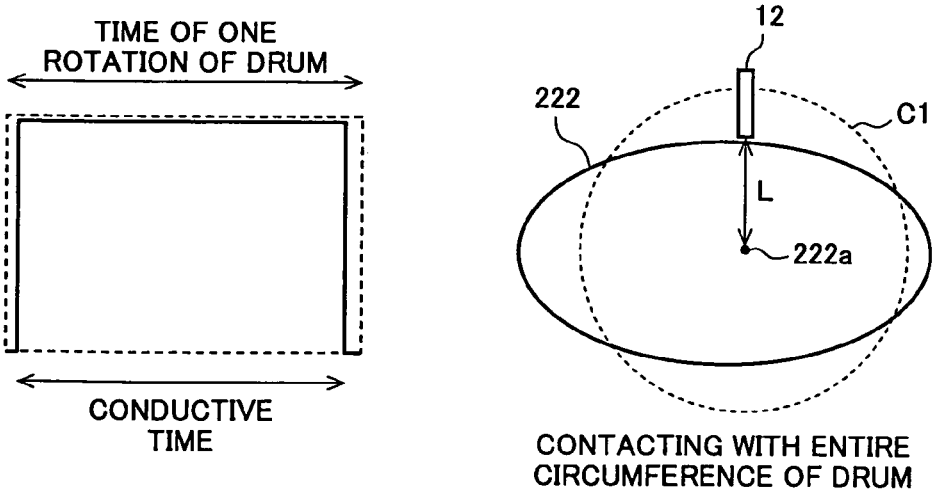

FIGS. 18A to 18C depict a method of adjusting a mounting position of the write head in the image forming apparatus of the third embodiment. In FIGS. 18A to 18C, a circle C1 depicted with a dotted line is an ideal photoreceptor drum, and an ellipse depicted with a solid line is the photoreceptor drum 222, which shows an example of an ellipse photoreceptor drum attached eccentrically. In FIG. 18A, a circle C2 depicted with a virtual line is a circle around the rotation shaft 222*a* of the photoreceptor drum 222, which has a radius of a distance L between the movable pin and the rotation shaft 222*a*, and the movable pin 12 comes in contact with a portion located outside of the circle C2 in the photoreceptor drum 222. Description will hereinafter be made of a method of adjusting the mounting position of the write head with the use of a conductive time display mechanism calculating and displaying a percentage of a conducting (contact) time per rotation of the photoreceptor drum relative to a time required for one rotation of the photoreceptor drum.

(First Process)

While the photoreceptor drum 222 is slowly rotated, the interval adjustment screw 30 is tightened to slowly move the movable pin 12 toward the photoreceptor drum 222. When the movable pin 12 comes in contact with a portion with the largest diameter of the photoreceptor drum 222 as shown in FIG. 18A, the conductive time display mechanism displays that one conductive period exists during one rotation of the photoreceptor drum 222 as shown in the left part of FIG. 18A.

(Second Process)

The interval adjustment screw 30 is further tightened to move the movable pin 12 closer toward the photoreceptor drum 222, and the display indicates that two conductive periods exist during one rotation of the photoreceptor drum 222 as shown in the left part of FIG. 18B.

(Third Process)

When the movable pin 12 is further moved closer to the photoreceptor drum 222, a large portion of one rotation of the photoreceptor drum 222 becomes the conductive period, and the display indicates that only the portion with the minimum diameter of the photoreceptor drum 222 does not contact with the movable pin 12 as shown in the left part of FIG. 18C. The moving distance of the movable pin 12, i.e., the amount of rotation for tightening the interval adjustment screw 30 to move the movable pin 12 is recorded with regard to the first process to the third process.

(Fourth Process)

Since the interval between the movable pin 12 and the photoreceptor drum 222 is a minimum distance when the third process is completed, the movable pin 12 is moved in the opposite direction by a half of the moving distance of the movable pin 12 and is held at an intermediate point. That is, if the interval adjustment screw 30 is tightened by ten turns in the first process to the third process, the interval adjustment screw 30 is loosened by five turns.

Fourth Embodiment

In the description of the image forming apparatuses of the first to third embodiments, when adjusting the interval between the LED head 227 and the photoreceptor drum 222, the rotation shaft 222*a* of the photoreceptor drum has been an extension of the center axis of the regulating member 7. However, if the center line of the photoreceptor drum is shifted and is not an extension of the center axis of the regulating member 7, the interval between the LED head 227 and the photoreceptor drum 222 is set smaller than a desired interval as the shift amount increases. Therefore, an image forming apparatus of a fourth embodiment provides a mechanism that eliminates the positional shift between the regulating member 7 and the photoreceptor drum when adjusting the interval between the LED head 227 and the photoreceptor drum 222.

Figure 19:
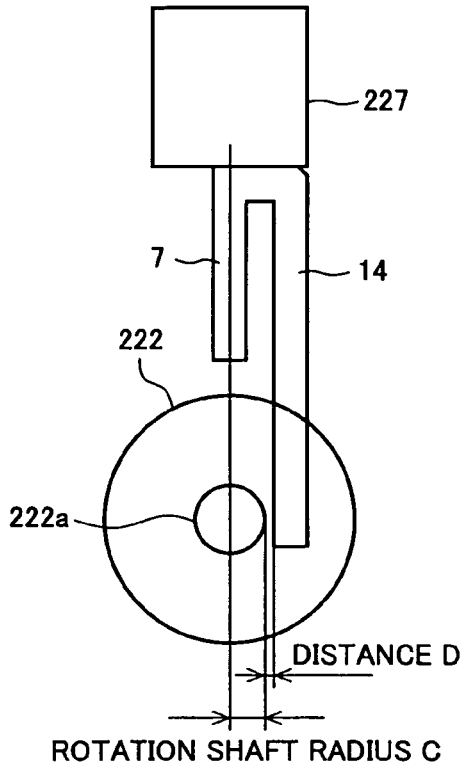
FIG. 19 depicts a relationship among a regulating member, a positioning member, and the photoreceptor drum in an image forming apparatus of a fourth embodiment.

FIG. 19 depicts a relationship among the regulating member, a positioning member, and the photoreceptor drum in the image forming apparatus of the fourth embodiment. The regulating member 7 of the LED head 227 is disposed with a positioning member 14 integrated with the regulating member 7. As shown in FIG. 19, the regulating member 7 and the positioning member 14 are in a positional relationship such that a distance D exists between one side surface of the positioning member 14 and the rotation shaft 222*a* when the rotation shaft 222*a* of the photoreceptor drum 222 is an extension of the regulating member 7.

Figure 20:
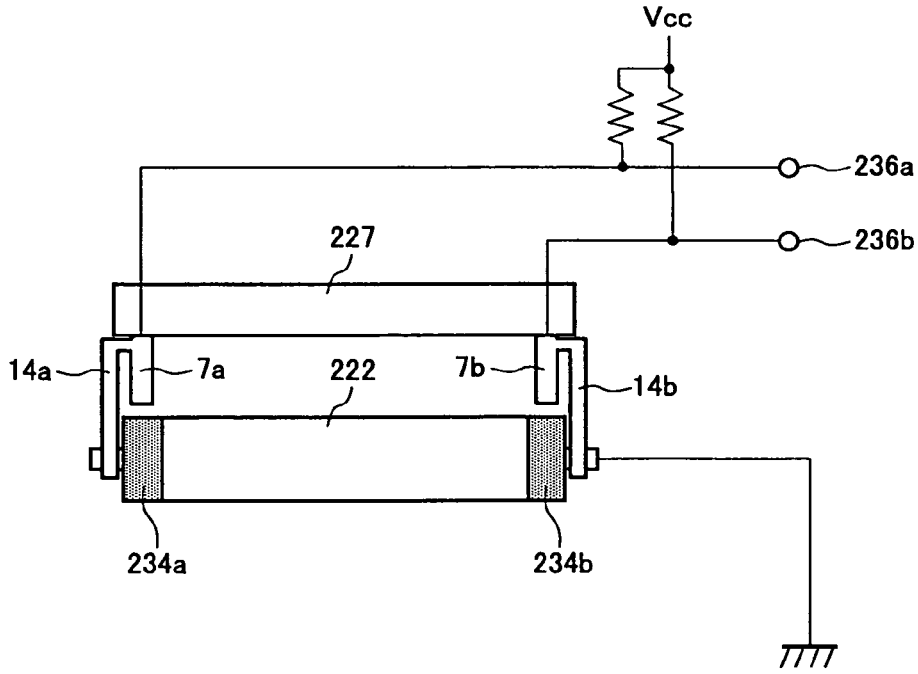
FIG. 20 depicts a contact detection mechanism for the regulating member and the positioning member used in the image forming apparatus of the fourth embodiment.

FIG. 20 depicts a contact detection mechanism for the regulating member and the positioning member used in the image forming apparatus of the fourth embodiment. The contact detection mechanism shown in FIG. 20 can detect whether the one side surface of the positioning member 14 comes in contact with the rotation shaft 222*a* of the photoreceptor drum 222. When adjusting the interval between the LED head 227 and the photoreceptor drum 222 to a desired interval, adjustment is firstly performed with the use of a mechanism that shifts the positioning member 14 and the LED head 227 in the sub-scanning direction, and the interval between the LED head 227 and the photoreceptor drum 222 is then adjusted to a desired interval as described in the first and second embodiments.

Figure 21A:
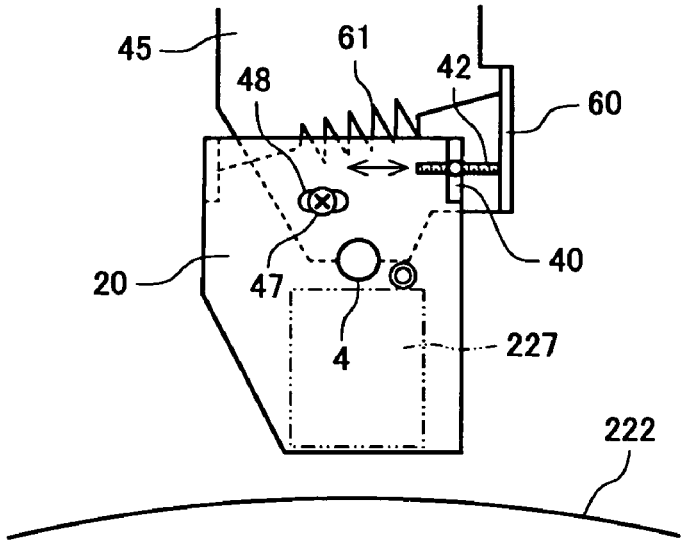
FIG. 21A is a side view of operation of shifting the write head in the sub-scanning direction, corresponding to a sectional view taken along line P-P of FIG. 16.
Figure 21B:
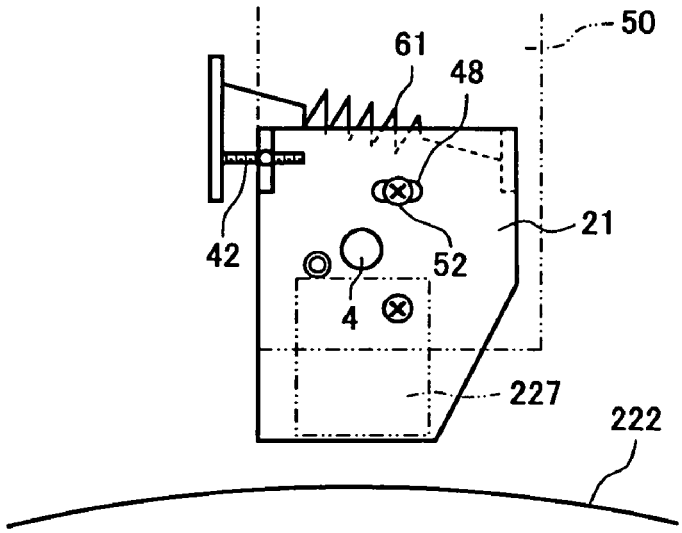
FIG. 21B is a side view of operation of shifting the write head in the sub-scanning direction, corresponding to a sectional view taken along line Q-Q of FIG. 16.

FIGS. 21A and 21B are side views of operation of shifting the write head in the sub-scanning direction; FIG. 21A is a diagram corresponding to a sectional view taken along line P-P of FIG. 16; and FIG. 21B is a diagram corresponding to a sectional view taken along line Q-Q of FIG. 16. The LED head 227 is rotatably attached to the inside of the frame member 6 including the first to third frames 20 to 22 by the support shaft 4, and the frame member 6 is rotatably attached to the first and second body frames 45, 50 of the image forming apparatus by the support shaft 4. The position adjustment can be performed in the sub-scanning direction relative to the photoreceptor drum 222 by loosening the first and second fixing screws 47, 52 movably attaching the frame member 6 to the first and second body frames 45, 50, by adjusting the position in a substantially elliptical elongate hole 48, and by tightening the screws.

FIGS. 22A to 22E depict a method of correcting a shift between the regulating member and the rotation shaft of the photoreceptor drum.

(First Process)

Figure 22A:
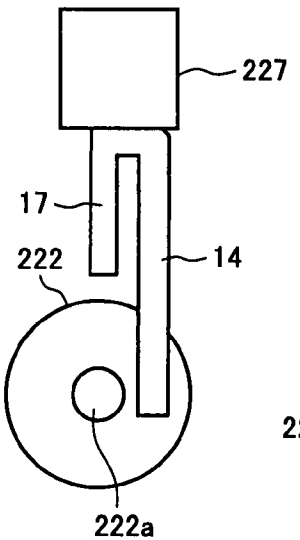
FIGS. 22A to 22E depict a method of correcting a shift between the regulating member and the rotation shaft of the photoreceptor drum.

If the rotation shaft 222*a* of the photoreceptor drum 222 is not an extension of the regulating member 7 as shown in FIG. 22A, the contact detection mechanism shown in FIG. 20 detects that the positioning member 14 does not contact with the rotation shaft 222*a* of the photoreceptor drum 222.

(Second Process)

Figure 22B:
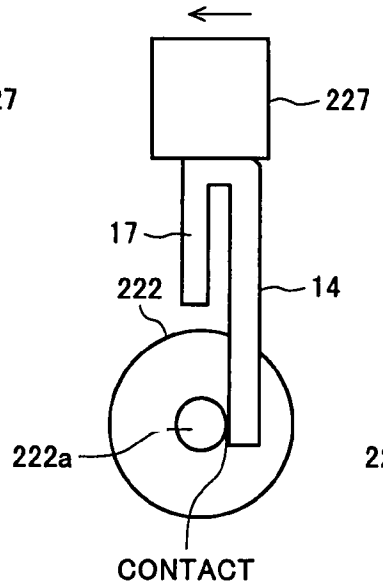

If it is detected that the rotation shaft 222*a* of the photoreceptor drum 222 is not an extension of the regulating member 7 in the first process, the mechanism of shifting the LED head in the sub-scanning direction as shown in FIGS. 21A and 21B is used to move the LED head 227 until the positioning member 14 comes in contact with the rotation shaft 222*a* with the use of the adjustment screws 47, 52 as shown in FIG. 22B.

(Third Process)

Figure 22C:
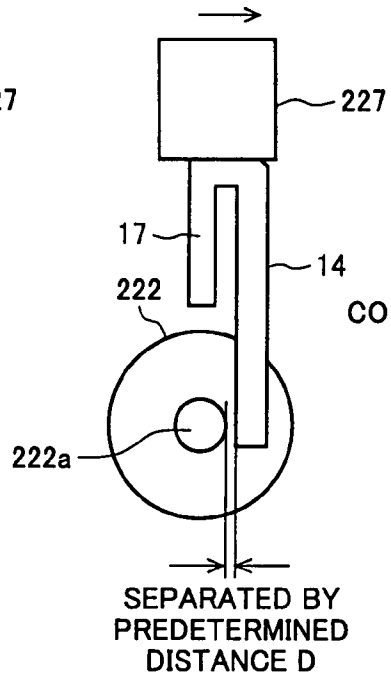

As shown in FIG. 22C, the LED head is then moved away from the rotation shaft 222*a* such that the distance D exists between one side surface of the positioning member 14 and the rotation shaft 222*a* of the photoreceptor drum 222.

(Fourth Process)

Figure 22D:
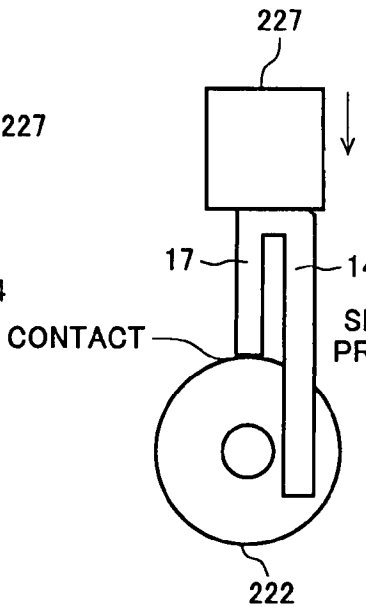

Since the predetermined relationship is established in the positional relationship between the LED head 227 and the photoreceptor drum 222 when the third process is completed, the method goes to a process of adjusting the interval between the LED head 227 and the photoreceptor drum 222 to a desired interval, and the regulating member 7 and the contact detection mechanism shown in FIG. 20 are used to set the interval H between the LED head 227 and the photoreceptor drum 222 to A-B with the same adjusting method as that performed in the image forming apparatus of the first and second embodiments as shown in FIG. 22D.

(Fifth Process)

Figure 22E:
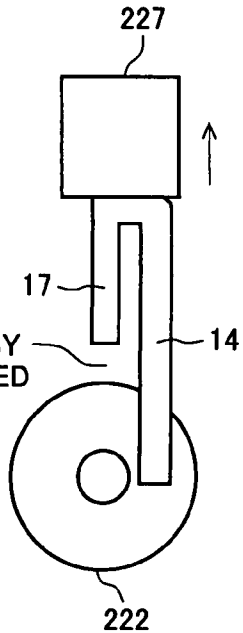

To set the interval H between the LED head 227 and the photoreceptor drum 222 to the desired reference interval A, the LED head 227 is moved away from the photoreceptor drum 222 by the distance B with the same adjusting method as that performed in the image forming apparatus of the first and second embodiments as shown in FIG. 22E.

Fifth Embodiment

Figure 23:
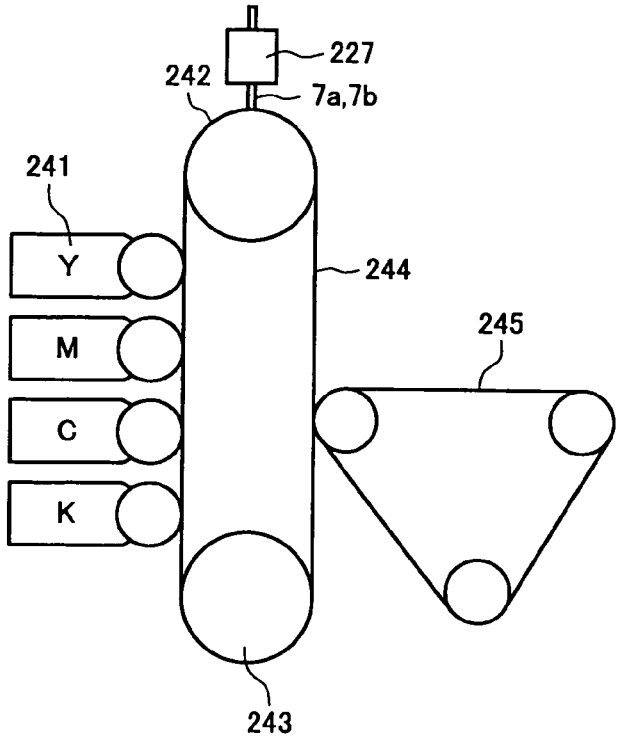
FIG. 23 depicts an image forming apparatus of a fifth embodiment.

FIG. 23 depicts an image forming apparatus of a fifth embodiment. The image forming apparatus of the fifth embodiment is an image forming apparatus using a photoreceptor belt and an intermediate transfer belt, instead of the image forming apparatus of the first or second embodiment including the photoreceptor drum. In the image forming apparatus of the fifth embodiment, the LED head 227 emits light based on print image data after an imaging process; each developing unit 241 of yellow, magenta, cyan, and black forms a toner image on a photoreceptor belt 244 stretched between belt support rollers 242, 243; the toner images are sequentially transferred to an intermediate transfer belt 245 for each color; after all the toner images are overlapped and transferred, batch transfer is performed onto the recording paper fed from a paper feed cassette; and after the batch transfer, a fixing device fixes the images to complete a full-color image. The image forming apparatus includes the same write head adjustment apparatus 3 as that of the image forming apparatuses of the first and second embodiments; the built-in LED head 227 includes the regulating member 7 (the first and second regulating members 7*a*, 7*b*); and the interval between the LED head 227 and the photoreceptor belt 244 surface can be adjusted by using the regulating member 7 as follows.

The regulating member 7 with the LED head 227 attached is moved toward and brought into contact with the photoreceptor belt 244, and the interval between the LED head 227 and the photoreceptor belt 244 is set to A-B, which is smaller than the reference interval A by the predetermined interval B. The contact detection apparatus shown in FIG. 6 detects that the regulating member 7 comes in contact with the photoreceptor belt 244. The regulating member 7 is moved along with the LED head 227 in the direction opposite to the photoreceptor belt 244 by the predetermined interval B. By performing the above operation for the first and second regulating members 7 disposed on the both sides of the photoreceptor belt 244, the interval between the LED head 227 and the photoreceptor belt 244 can be set to the reference interval A across the full width of the photoreceptor belt.

Figure 24:
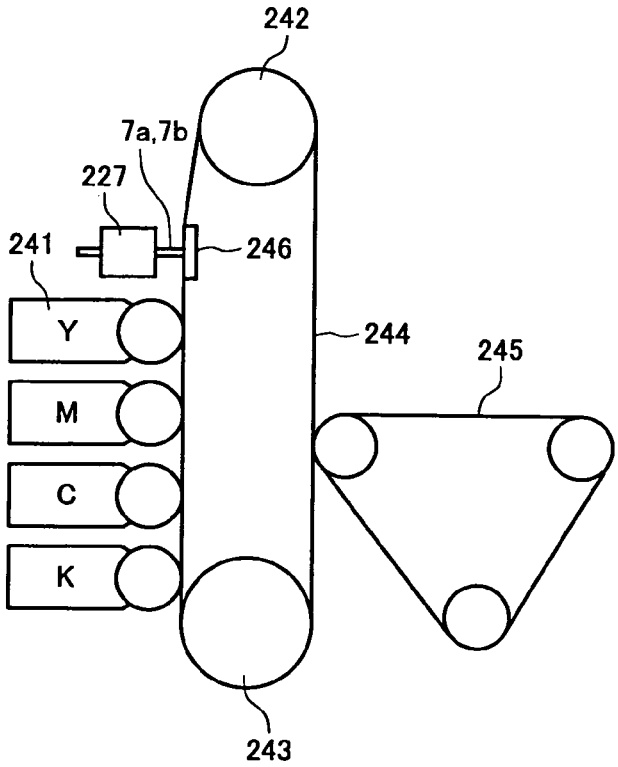
FIG. 24 depicts a modified image forming apparatus of the fifth embodiment.

FIG. 24 depicts a modified image forming apparatus of the fifth embodiment. As compared to the image forming apparatus of the fifth embodiment shown in FIG. 23, the modified image forming apparatus is different in the mechanism and method of adjusting the interval between the LED head 227 and the photoreceptor belt 244 surface. In the image forming apparatus of this example, a belt-backside pressing support member 246 is disposed at the backside of a part of the photo-receptor belt 244 at which the LED head 227 is located such that the photoreceptor belt 244 is pressed from the backside in the direction of the photoreceptor belt 244. The interval between the LED head 227 and the photoreceptor belt 244 surface can be adjusted by using the regulating member 7 (the first and second regulating members 7*a*, 7*b*) and the belt-backside pressing support member 246 as follows.

The belt-backside pressing support member 246 is used to push out the photoreceptor belt 244 toward the LED head 227 for a distance corresponding to the interval B described above. The regulating member 7 is then moved along with the LED head 227 in the direction of the photoreceptor belt 244 to bring the regulating member 7 into contact with the photoreceptor belt 244. The contact detection apparatus shown in FIG. 6 detects that the regulating member 7 comes into contact with the photoreceptor belt 244. The interval between the LED head 227 and the photoreceptor belt 244 surface can be set to the reference interval A by restoring the belt-backside pressing support member 246 to return the photoreceptor belt 244 to the original state.

According to the present invention, the following advantages can be acquired.

In the image forming apparatus and the adjusting method of the image forming apparatus of the present invention, since the adjusting mechanism adjusts the interval of the write head and the photoreceptor to the reference interval (A) and includes the regulating member that integrally moves with the write head for a predetermined distance to regulate the interval between the write head and the photoreceptor, even an unskilled user can easily check and adjust the interval between the write head and the photoreceptor highly accurately.

In the present invention, the interval between the write head and the photoreceptor is set to be smaller than the reference interval (A) by the predetermined dimension (B) when the regulating member comes into contact with the photoreceptor; a moving mechanism is included to integrally move the regulating member along with the write head and to bring the regulating member into contact with the photoreceptor; a reverse-moving mechanism is included to integrally move the regulating member along with the write head in the direction opposite to the photoreceptor by the predetermined dimension (B) after the regulating member comes into contact with the photoreceptor; and, therefore, even an unskilled user can easily check and adjust the interval between the write head and the photoreceptor.

In the present invention, the interval between the write head and the photoreceptor is set to a length of the reference interval (A) when the regulating member comes into contact with the spacer mounted to the photoreceptor, which has a thickness of the predetermined dimension (B); a mechanism is included to mount the spacer to the photoreceptor; a moving mechanism is included to integrally move the regulating member along with the write head and to bring the regulating member into contact with the spacer; a mechanism is included to remove the spacer after the regulating member comes into contact with the spacer; and, therefore, even an unskilled user can easily check and adjust the interval between the write head and the photoreceptor.

In the present invention, the contact detection mechanism electrically detects that the regulating member comes into contact with the photoreceptor or the spacer to perform notification of the detection result and, therefore, even an unskilled user can easily detect the contact between the regulating member and the photoreceptor or the spacer and can easily check and adjust the interval between the write head and the photoreceptor.

In the present invention, an evacuation mechanism is included to evacuate the regulating member and, therefore, the pin-shaped regulating member can be prevented from contacting and damaging the photoreceptor surface or from being deformed at the time of replacing the photoreceptor.

In the present invention, when adjusting the interval between the write head and the photoreceptor, the regulating member is brought into contact with the photoreceptor holding member while the photoreceptor is rotated and, therefore, contact failure can be prevented from occurring due to oxide, foreign matters, etc., attached to the surfaces of the photoreceptor holding member and the regulating member.

In the present invention, when adjusting the interval between the write head and the photoreceptor, the interval adjustment is performed at an intermediate rotation position between a rotation position of the photoreceptor drum where the distance between the write head and the photoreceptor is maximized and a rotation position of the photoreceptor drum where the distance between the write head and the photoreceptor is minimized and, therefore, the photoreceptor surface can be adjusted to be within the range of the focal depth of the write head during one rotation of the photoreceptor drum.

In the present invention, when adjusting the interval between the write head and the photoreceptor, the interval between the write head and the photoreceptor can be accurately adjusted by adjusting the interval between the write head and the photoreceptor after correcting the shift in the sub-scanning direction between the regulating member and the photoreceptor drum such that the shape of the exposure spot applied to the photoreceptor is adjusted to a perfect circle.

In the present invention, a distance between the center axis line of the regulating member and the contact position that brings a sub-scanning direction position detecting member into contact with the rotation shaft of the photoreceptor is set larger than the radius (C) of the rotation shaft of the photoreceptor drum by the predetermined distance (D); when detecting contact with the rotation shaft, the sub-scanning direction position detecting member is moved away from the contact position by the predetermined distance (D); and, therefore, both sides can be prevented from wearing to highly accurately adjust the interval between the write head and the photoreceptor for a long period.

The invention claimed is:

1. An image forming apparatus comprising:

an adjusting mechanism, including regulating members which are disposed at each of both ends in the width direction of a photoreceptor of a write head, that adjusts an interval between the write head writing an optical image on the photoreceptor and the photoreceptor to a reference interval, wherein the adjusting mechanism detects contact between each of the regulating members and respective non-image forming areas provided at both ends of the photoreceptor by sensing electric conduction, and then moves the regulating members together with the write head apart from the surface of the photoreceptor by a predetermined distance to adjust the writing position of the write head in relation to the surface of the photoreceptor.

2. The image forming apparatus of claim 1, wherein the adjusting mechanism includes;

a contact detection mechanism that detects the contact between the regulating members and the photoreceptor by sensing the electric conduction; and a mechanism that performs notification of the detection result of the contact detection mechanism.

3. The image forming apparatus of claim 1, wherein the regulating member contacts with the non-image forming areas, which are conductive, disposed at both ends of the photoreceptor and a moving mechanism and a reverse-moving mechanism can independently move both ends of the write head.

4. The image forming apparatus of claim 1, wherein when adjusting the interval between the write head and the photoreceptor, the regulating member is brought into contact with the photoreceptor while the photoreceptor is rotated.

5. The image forming apparatus of claim 1, comprising:

an evacuation mechanism that evacuates the regulating member.

6. The image forming apparatus of claim 1, wherein the photoreceptor is drum-shaped.

7. The image forming apparatus of claim 1, wherein the write head is an LED head.

8. The image forming apparatus of claim 1, wherein the photoreceptor is belt-shaped.

9. An adjusting method of an image forming apparatus, the apparatus, comprising an adjusting mechanism that adjusts an interval between a write head writing an optical image on a photoreceptor and the photoreceptor to a reference interval, the adjusting mechanism including regulating members that integrally move along with the write head in the direction of the photoreceptor to regulate the interval between the write head and the photoreceptor, the method comprising the steps of:

detecting contact between each of the regulating members, which are disposed at each of both ends in the width direction of the photoreceptor of the write head, and respective non-image forming areas provided at both ends of the photoreceptor by sensing electric conduction, and then moving the regulating members together with the write head apart from the surface of the photoreceptor by a predetermined distance to adjust the writing position of the write head in relation to the surface of the photoreceptor.

* * * * *